US005884490A

United States Patent [19]

Whidden

[11] Patent Number: 5,884,490

[45] Date of Patent: Mar. 23, 1999

[54] METHOD AND APPARATUS PRODUCING CLEAR ICE OBJECTS UTILIZING FLEXIBLE MOLDS HAVING INTERNAL ROUGHNESS

[76] Inventor: William L. Whidden, 8300 Honolulu Dr., Orlando, Fla. 33818

[21] Appl. No.: 40,032

[22] Filed: Mar. 17, 1998

Related U.S. Application Data

[63] Continuation-in-part of Ser. No. 82,455, Mar. 25, 1997, abandoned.

[51] Int. Cl.[6] ..... F25C 1/18; F25C 1/22

[52] U.S. Cl. ..... 62/70; 62/72; 62/356

[58] Field of Search ..... 62/69, 70, 72, 62/353, 356

[56] References Cited

U.S. PATENT DOCUMENTS

| | | | |
|---|---|---|---|
| 1,254,511 | 1/1918 | Kleucker | 62/70 |
| 1,322,660 | 11/1919 | Voorhees | 62/356 |
| 1,476,220 | 12/1923 | Reynolds | 62/70 |
| 2,133,521 | 10/1938 | Wussow et al. | 62/70 |
| 2,939,299 | 6/1960 | Sherbloom | 62/1 |
| 4,206,899 | 6/1980 | Whitehead | 249/139 |
| 4,217,762 | 8/1980 | Sakamoto et al. | 62/70 |
| 4,550,575 | 11/1985 | DeGaynor | 62/308 |
| 4,562,991 | 1/1986 | Wu | 249/141 |
| 4,601,174 | 7/1986 | Wilson | 62/66 |
| 4,669,271 | 6/1987 | Noel | 62/60 |
| 4,739,963 | 4/1988 | Parmacek et al. | 249/61 |
| 4,807,844 | 2/1989 | Tu | 249/78 |
| 5,076,069 | 12/1991 | Brown | 62/308 |

*Primary Examiner*—William E. Tapolcal
*Attorney, Agent, or Firm*—Julian C. Renfro, Esq

[57] ABSTRACT

A support arrangement for supporting a flexible, water-containing mold of intricate configuration in a tank having supporting sides and containing a chilled liquid, such that an item of crystal clear ice can be created in the flexible mold. The flexible mold has an upper, support portion and a lower, principal portion, and also has interior surfaces possessing a distinctive degree of roughness. The support arrangement involves elongate support means for operatively engaging the upper portion of the mold, with the elongate support means being of a length sufficient to span between the supporting sides of the tank such that the mold can be supported with a selected extent of the principal portion of the mold immersed below the surface of the chilled liquid. Circulation of the water in the mold is brought about so that the interior sides of the mold will be swept, thus preventing the formation of cloudy ice. The arrangement for causing circulation of the water in the mold may involve a gas supply utilized for supplying controlled amounts of gas to a lower interior portion of the mold so that suitable amounts of gas can be caused to rise up through the water in the mold and prevent the formation of cloudy ice. Other arrangements for causing circulation of the water in the mold may include power driven rotatable means disposed in the mold.

27 Claims, 13 Drawing Sheets

FIG 7
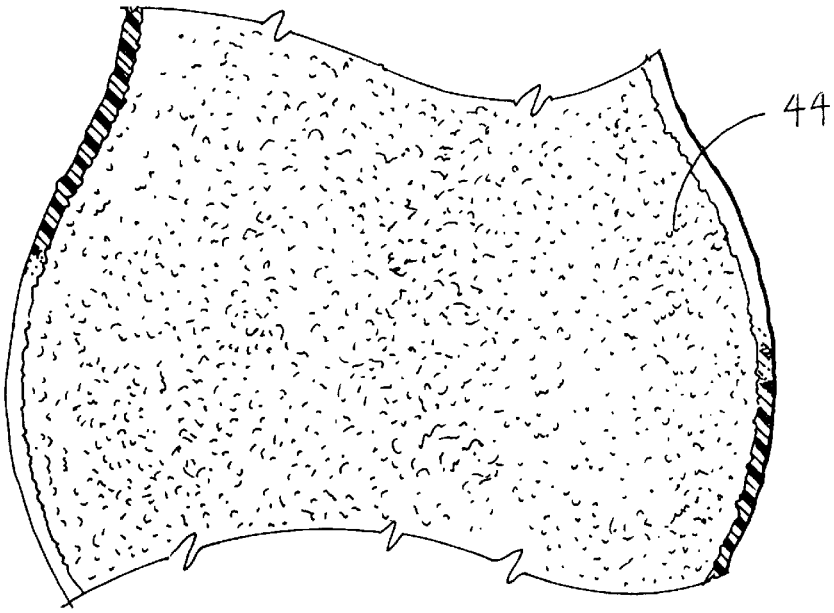
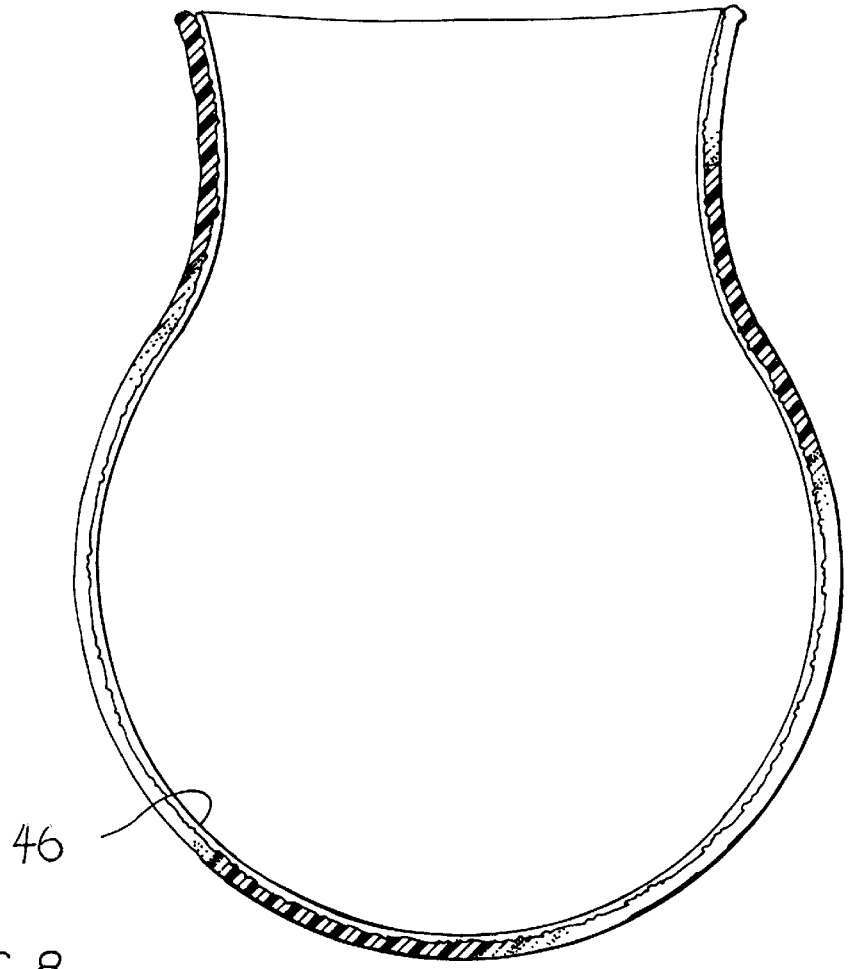
FIG 8

FIG 9
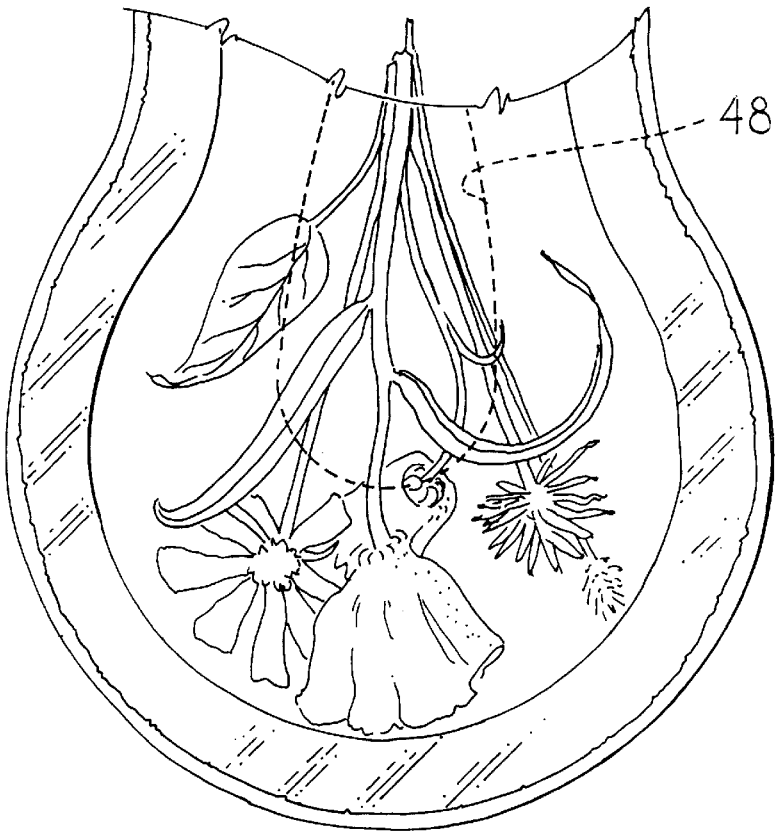
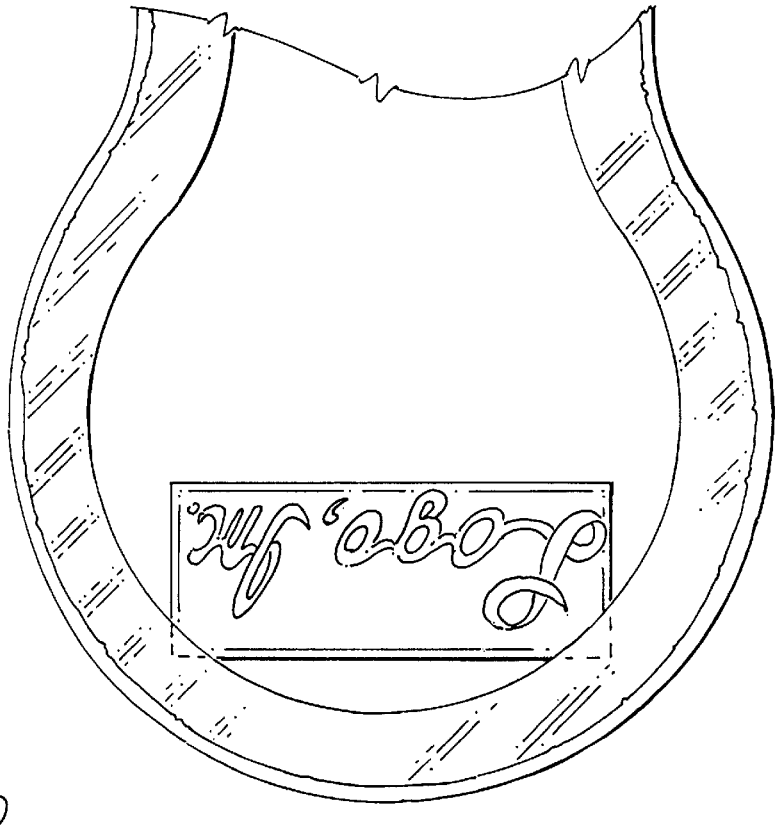
FIG 10

FIG 15
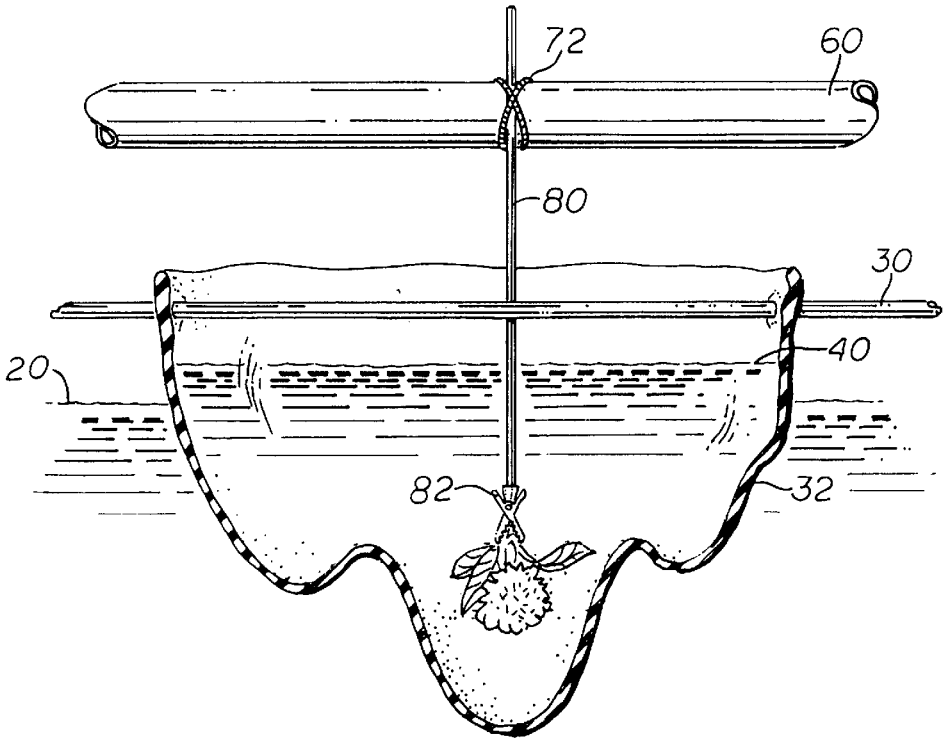
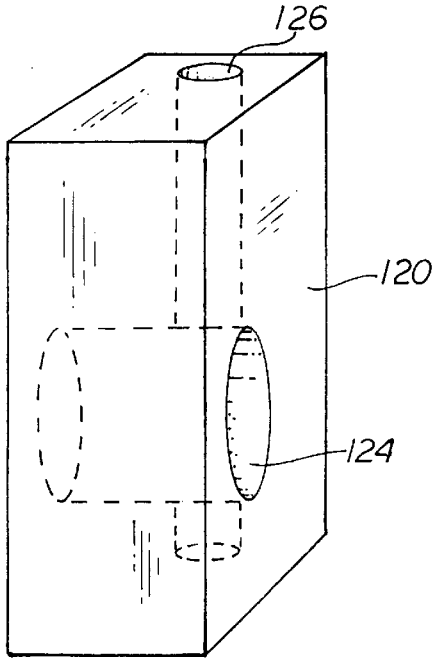
FIG 16a
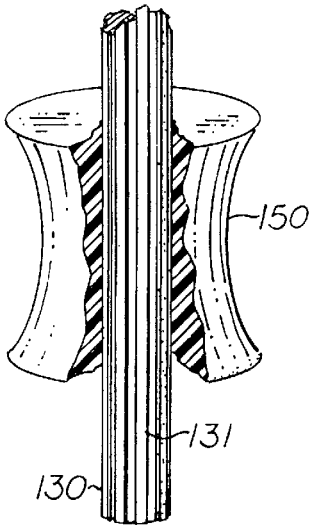
FIG 16b

METHOD AND APPARATUS PRODUCING CLEAR ICE OBJECTS UTILIZING FLEXIBLE MOLDS HAVING INTERNAL ROUGHNESS

RELATIONSHIP TO EARLIER INVENTION

This invention may be regarded as a Continuation-in-Part of my application entitled "METHOD AND APPARATUS FOR PRODUCING CRYSTAL CLEAR ICE OBJECTS UTILIZING FLEXIBLE REUSABLE MOLDS," Ser. No. 08/824,559, filed Mar. 25, 1997, which application is to be abandoned with the filing of this Continuation-in-Part application. The recitations and details set forth in the earlier application are hereby incorporated by reference into this application.

BACKGROUND OF THE INVENTION

This invention relates to a method and novel apparatus for forming ice objects of intricate configuration, and has particular application in the formation of decorative ice statuary and the like to be utilized at banquets, wedding receptions and similar festive occasions to decorate the tables in a unique and impressive manner. Such ice statuary also has application in the decoration of windows of restaurants and the like.

Ice sculptures have long been appreciated for their aesthetic appearance, due primarily to the smoothly flowing and/or artistic surfaces of the ice and to the clarity of the ice and its ability to transmit light therethrough. Ice sculptures have often been used as distinctive decorations for banquets, celebrations, and many other such business or joyous occasions. When fashioned as bowls, the ice sculptures can also provide a desired cooling effect upon the punch or other liquid contained in the bowl.

In the past, ice sculptures involving unusual shapes have generally been fabricated from large blocks of clear ice, using special tools to chip, form, and smooth the ice. Chain saws are frequently used to form large ice sculptures. Such techniques involve a great deal of the mass of the original block of ice being wasted. Moreover, the labor involved in forming the ice sculpture has resulted in high cost of the sculptures. In many localities, artists of sufficient skill to carve attractive ice statuary are simply not available.

Some ice statuary has earlier been created by the use of molds formed from metal or the like, with punch bowls and other cavity-containing objects being typical. Such metal molds are filled with water and then immersed to an appropriate extent in a cooling medium such as a tank of brine or glycol equipped with refrigeration coils. Such immersion is usually within an inch or two from the top of the mold. To assure clarity of the ice, compressed air is inserted near the bottom of each mold during the freezing process. After ice has formed to a desired thickness, the mold is removed from the tank and then maintained in an inverted position until a degree of melting takes place and the ice object drops out of the mold.

One distinct advantage of the use of molds of this type is that these improved techniques have permitted the inclusion of various decorative elements, such as flowers, bright objects, letters, paper letters, or other decorative or visual indicia, within the structure of the ice bowl.

It is quite difficult by the use of metal molds, however, to create ice objects of intricate shape, and any "undercut" created in the mold would make removal of the ice object from the mold nearly impossible.

Exemplary of the prior art teachings is U.S. Pat. No. 2,545,592 to Sherbloom wherein is disclosed a method of forming ice molded figures by the utilization of a split mold adapted to be immersed in a can that is subsequently placed in a refrigerated tank of brine. However, the apparatus necessary for the practice of prior art methods has been relatively cumbersome and has precluded the adoption of these methods by relatively small restaurants, hotels and the like.

A method of molding ice sculptures is described in U.S. Pat. No. 4,206,899 to Whitehead, with this method involving supporting a water-filled flexible mold in an inverted position within a rectangular outer box. Because of the hydrostatic pressure of the water, especially with large sculptures, the flexible mold must be of sufficiently thick wall structure to prevent distortion. In addition, this method uses a walk-in freezer or the like, which causes a freezing of the mold from all sides including the top of the water level. This in turn causes the ice to "crust over" which traps in all the air on the inside of the mold, causing cloudy and cracked ice.

The necessary thick-walled flexible molds are expensive to make and difficult to peel off the ice sculpture. It is also found that sculptures made by the method and apparatus of U.S. Pat. No. 4,206,899 contain cracks which detract from the appearance and structural integrity of the sculpture. Such sculptures are typically quite cloudy due to lack of circulation, and in addition, the mold must be placed in a freezer.

Whitehead utilizes a mold in its base through which support wires are inserted. The mold is inverted, base up, within a box slightly larger than the mold with the wires engaging the open top of the box and supporting the mold. After the mold is filled with water and frozen, it is removed from the box and the mold is stripped from the frozen sculpture.

The single part mold used by Whitehead is of such a nature as to be restricted to sculptures which taper more or less uniformly from top to bottom so that the mold can be removed from the finished sculpture. The Whitehead mold could not, for example, be used to mold an ice sculpture having relatively small top and bottom portions and an enlarged central portion. Furthermore, the Whitehead mold can only be used to make relatively small ice sculptures due to the nature of the flexible material Whitehead uses for his molds. If his molds were larger, the weight of the water would expand the bottom of the mold.

Although it has previously been known to create crystal clear ice by the use of reusable metal molds, in order to prevent cloudiness of the resulting ice, it has been common practice to circulate the water in the mold to remove air bubbles. Such circulation is typically brought about by an aeration arrangement. Without sufficient circulation, crystal clear ice simply cannot be obtained.

The Reynolds U.S. Pat. No. 1,476,220 entitled "Method of and Means for Agitating Water in Ice Making Apparatus" teaches the use of an ice or brine tank 10 within which are placed ice cans 11 containing the fresh water to be frozen into ordinary ice blocks. This patentee utilizes what he calls an agitator pipe 18 in each ice can 11, for the introduction of air supplied from a blower 12. Reynolds explains that as a result of agitating the water, the impurities will collect. When the water has changed to ice, except for a small core in the middle of the can, this water with the impurities may be removed, and distilled water substituted.

It is obvious that Reynolds discloses nothing pertaining to the creation of ice objects of intricate configuration by the use of flexible molds, for he is entirely concerned with the creation of ordinary ice blocks, presumably for home or commercial use.

It is obvious that when using reusable metal molds, one end of the mold must be larger than the other end, and no "undercuts" may be utilized. Otherwise, it would not be possible to remove the completed ice structure without destroying the mold or else melting substantial portions of the ice object.

An alternative to the use of metal molds has been the use of hard plastic molds, with in many instances such molds being destroyed when the ice sculpture is to be removed. However, this is obviously an expensive approach.

In the Sherbloom U.S. Pat. No. 2,545,592 it was taught that two-part molds can be utilized, which molds are secured together and then immersed in brine or other cold liquid in order to bring about the freezing of the contents of the mold. However, nothing is said in Sherbloom about providing aeration, so the ice objects resulting from the use of Sherbloom's technique will be of cloudy ice rather than crystal clear ice. Even if Sherbloom created the parts of the mold that come together, this would not allow sufficient circulation, causing dead spots in the mold where the water is stagnant, thus creating cloudy pockets of ice.

Another Sherbloom patent is U.S. Pat. No. 2,939,299, which also utilizes two-part molds of hard material. Sherbloom obviously discovered that he could not create objects of crystal clear ice without aeration, so in Column 4 of this more recent patent, Sherbloom describes how his mold sections are aerated continuously through air hoses 48 during the freezing process to produce a frozen object characterized by the clarity of the ice from which it is molded. How Sherbloom prevents his air line from freezing in place is not described, however.

It is to be noted from the drawings of the Sherbloom U.S. Pat. No. 2,939,299 that the objects he creates are comparatively flat. In other words, two dimensional objects can be created, but not three dimensional objects. Three dimensional objects have deep crevices. Sherbloom utilizes hard, non-flexible molds, which simply cannot have three dimensional, lifelike undercuts.

With reference to the Whitehead U.S. Pat. No. 4,206,899, it will be noted that this patentee utilizes molds fabricated from form-retaining, flexible, resilient plastic material. However, from the material he utilizes for his molds, it is apparent that if the molds are too thick, it will be exceedingly difficult to remove the completed ice sculpture from the mold, but on the other hand, if the material from which the mold is made does not have enough character or thickness, the object created in the mold will take on a "bulged out" appearance and not be faithful to the intended configuration.

It is significant to also note with respect to the Whitehead patent that he may utilize the environment of a walk-in freezer for bringing about the freezing of the water in the mold, but in such instance, the icing over of the water in the top of the mold will prevent any effective aeration of the water in the mold. As a result, cloudy ice will predictably result from the utilization of this Whitehead technique.

With reference to the DeGaynor U.S. Pat. No. 4,550,575 entitled "Ice Bowl Freezing Apparatus," it is obvious that no intricate shapes are possible, for when using metal molds, the ice object would be impossible to remove should any "undercut" be present. DeGaynor recognizes the advantage of providing air circulation, but it would be impossible utilizing DeGaynor's technique to create any ice object of intricate configuration, such as statuary or the like.

With reference to the Wu U.S. Pat. No. 4,562,991, it will be noted that although Wu employs a reusable ice mold that allegedly produces intricate ice objects, it is obvious from FIGS. 1 and 6 that the fowl depicted in these figures is of "chunky" and non-intricate configuration. Also, because no aeration or circulation is mentioned, Wu will not be able to create crystal clear objects by the practice of his method.

The Noel U.S. Pat. No. 4,669,271 is concerned with multi-part molds, but he utilizes his molds in a walk-in freezer. For this reason, the upper surface of the water in the mold will ice over, thus trapping inside the mold, any air bubbles that may be present, thus resulting in the formation of a cloudy ice object. Most importantly, no circulation is possible.

The Parmacek et al U.S. Pat. No. 4,739,963 is concerned with plastic molds, with his improvement being a hollow core formed in the base of the mold to allow for expansion in the mold when it changes phase into ice. Because of this arrangement, these patentees maintain that they reduce stress and cracking in the finished ice form. The Parmacek et al patent process allows one-time only use of the mold, with the mold being destroyed after use.

However, nothing is said in the Parmacek et al patent about the use of aeration or circulation, so crystal clear ice will not result from a practice of that method.

The Tu U.S. Pat. No. 4,807,844 utilizes a mold of elastomeric material, but he places his mold in a walk-in freezer and says nothing about aeration. Inasmuch as the placement of the mold in a walk-in freezer necessarily brings about an icing over of the water in the top of the mold, any circulation induced by the utilization of compressed air or any other method would result in the entrapment of the bubbles in the ice. Tu's method will definitely not result in the creation of crystal clear ice.

SUMMARY OF THE INVENTION

In contrast with these prior art patents, my novel support arrangement is designed to support a flexible, water-containing mold of intricate configuration in a tank containing a chilled liquid, such that an item of crystal clear ice can be created in the flexible mold. The flexible mold has an upper, support portion and a lower, principal portion, with the support arrangement including support means operatively engaging the upper portion of the flexible mold. The mold is supported with a selected extent of the principal portion of the mold immersed below the surface of the chilled liquid, with means being utilized for causing circulation of the water in the mold, so that the interior sides of the mold will be swept, thus preventing the formation of cloudy ice.

The needed circulation of the water in the mold may be brought about by supplying controlled amounts of a gas, such as air, to a lower interior portion of the mold, with the gas caused to rise up through the water in the mold assuring adequate circulation. As one alternative, the means for causing circulation of the water in the mold can include power driven rotatable means disposed in a lower portion of the mold. As another alternative, a submersible pump could be used in a mold in which the water jet directs water upward, downward, or in a swirling motion around the mold.

Inasmuch as in the practice of one embodiment of my invention additional water will be added to each mold during the procedure of obtaining crystal clear ice objects, it is desirable to be able to change the relationship between the level of the coolant liquid in the tank, and the level of the water in each mold. One approach is to utilize height adjustment means under the control of the user for adjusting the height of each mold with respect to the sides of the tank, whereas in accordance with another approach, an inflatable bladder disposed below the surface of the chilled liquid in the tank may be caused to inflate to a selected degree, thus to raise the level of the coolant in the tank with respect to each mold suspended in the tank.

It is to be understood that my invention also includes a highly advantageous method utilizing a chilling tank containing glycol, brine or other suitable chilling solution which will maintain its liquid form throughout the duration of the ice molding process, with refrigeration coils typically being located on the interior portion of the tank. As an alternative to this, the chilling coils may be located in a separate chilling tank, with the arrangement in either event being such that the liquid in the chilling tank can be maintained at a desired low temperature.

Into an upper portion of the chilling tank, the lower or principal portion of one or more flexible molds, such as of a silicone type material, are supported by some appropriate means. This may involve the use of elongate support means, typically adjustable height steel rods.

These steel rods are long enough to extend from one side of the tank to another, and are designed to pass through reinforced holes located just below the upper, support portion of the flexible molds. The operator pours water into each suspended mold, with a careful relationship being maintained between the level of the water in each mold, and the level of the surface of the liquid in the chiller tank.

The flexible silicone type material preferably utilized in accordance with this invention has proven satisfactory for the creation of ice objects and items of intricate configuration, for ice objects of widely varying configuration may be readily removed by a sufficient stretching of the mold. However, I have found that the heat transmissivity and the internal texture of the silicone type material is quite different from that of the metal molds used by many others. I have established that a wide range of very intricate objects can be created in crystal clear ice as long as the internal surface of a silicone type mold has a desirable degree of roughness, and as long as proper aeration, circulation or sweeping of the sides of the newly formed ice is brought about.

In accordance with a preferred embodiment of my invention, the desired circulation is accomplished by a flow of gas provided to the interior of the mold during the freezing process. A relatively small, flexible gas supply tube can be utilized in accordance with this embodiment of my invention for providing a steady flow of gas, such as air, into a lower interior portion of each mold, to assure the creation of crystal clear ice.

After many years of experimentation, I have found that an object or item of crystal clear ice simply cannot be created unless sufficient circulation of the water in the mold takes place during the time ice is being formed in the mold.

I have discovered that certain problems necessarily accompany the use of these flexible molds of silicone and the like, with some of these problems being associated with the fact that flexible silicone type material is not as good a conductor of heat as metal molds. I have also found that if the internal surface of a flexible mold of silicone or the like is quite smooth, it becomes quite difficult to create crystal clear ice objects therein.

Inasmuch as the silicone type material preferably used in mold construction is typically positively buoyant, the mold will tend to float in the chilling solution utilized for bringing about freezing unless the mold is at least partially filled with water to be frozen, with it being desirable for the level of the water in the mold to be above the level of the chilling solution in the tank. Furthermore, the flexible molds must be provided with an upper portion containing sufficient reinforcement. This is so that the mold suspension arrangement, preferably support means involving the aforementioned elongate steel rods suspending the lower portion of the mold in proper contact with the surface of the chilling solution, will not bring about tearing or distortion of the mold.

In addition, when pouring water to be frozen into the mold, the workman must be attentive to liquid levels, for it is not desirable to permit the chilling solution from the chilling tank to enter the mold, and it is not particularly advantageous for excess water poured into the mold flowing into the glycol or brine inasmuch as too much dilution or contamination of the chilling solution could prove undesirable.

Unless a certain minimum amount of water has been poured into the mold, the pressure of the chilling solution on the outer surface of the mold will prevent the mold from expanding out into its full configuration, thus to result in the creation of an ice object that is distorted or undersize. In most instances, the level of the water in each mold will be an inch or two higher than the level of the chilling solution in the chilling tank.

I may provide one or more index marks or other types of markings on the upper interior portion of each silicone mold, to aid the workman or attendant in adding a desired amount of water to each mold. This and other steps may be automated in the case of high volume production.

During the procedure of creating crystal clear ice objects, inasmuch as the upper part of each silicone mold is open, the workman or attendant can easily insert a small flexible gas supply tube into a lower portion of each mold, so that circulation can be induced in each mold. A suitable gas, such as air, is supplied through the gas supply tube, which rises up through the water in the mold and causes a substantial circulation of the water being frozen. As possible alternatives to the use of air, I may utilize gases such as nitrogen, argon, oxygen, or a combination of non-harmful gases.

It is to be understood that I am not limited to the use of a compressed gas for bringing about a desirable amount of circulation in the water contained in each mold. For example, I may utilize mechanical means, such as a propeller-like device mounted on the lower end of a rotatable shaft extending into each mold, for creating a desirable amount of circulation of the water in each mold, or as another alternative, I could use a submersible pump in which a water jet directs water upward, downward, or in a swirling motion around the mold.

With regard to ice formation, it is to be noted that when utilizing metal molds, it can be reliably predicted that the water in the mold will begin to freeze in the region of 31° F. to 32° F.

In a metal mold, when the water temperature reaches 31° F., ice crystals will begin to form and stick to the sides of the mold. As the water continues to freeze, the ice simply grows inward. What tends to happen in molds other than metal is that when the water gets to 31° F., there is no attachment factor for the crystals. As a result, the water tends to get colder than 31° F., sometimes down to 29° F., before the crystals finally start to form.

When utilizing a water filled silicone mold suspended in contact with the surface of chilling solution maintained at some point below water freezing temperatures, I have found that freezing does not readily take place until a temperature of approximately 28° F. has been reached, and in some instances, a temperature as low as 26° F.

As a significant factor, when utilizing a synthetic rubber, plastic, or silicone mold, ice does not properly attach itself to the sides of the mold, as is the case with previously used and currently used metal molds.

When the ice finally begins to form in synthetic, plastic, rubber, or silicone molds, it does so in a fashion that resembles what I call "slushing." I use the term "slushing" to describe ice crystals aimlessly floating around, not attached to anything.

If this slushing condition is left "as is" in a non-metal mold, very cloudy ice will result, due to air trapped between the ice crystals. This inherent problem accompanying the use of non-metallic flexible molds has caused us to contrive a process called "de-slushing". This involves a selective addition of heat to the interior of the mold so that a considerable portion of the already-formed ice crystals will melt, thus making it possible for proper ice to begin to form.

If such an amount of heat is added that all the ice crystals in the mold are melted, the process will simply repeat itself. However, I add enough heat to melt only the crystals floating in the middle of the mold, and allow crystals to remain on the edge of the mold.

For example, if it is desired to de-slush a flexible mold designed to hold 2½ gallons, I may use approximately one quart of water at a temperature of 72° F. in order to cause the ice crystals randomly formed in the center of the mold to disappear.

The crystals remaining attached to the edge of the mold after de-slushing are basically what I call "seed ice." As the water in the mold continues to freeze subsequent to "de-slushing," this "seed ice" enables future crystals to attach properly. This, along with the sweeping of the ice during the freezing process, will allow ice to form in a highly advantageous manner such that a crystal clear ice object can be created.

I have found that the use of a mold with very smooth sides makes the formation of "seed ice" almost impossible. This is because the warmth added to the water in the mold kills all of the ice crystals it encounters. In other words, if the seed ice cannot, in effect, hide from the warmth, it also will be melted and the entire process must start over.

I have found that a degree of roughness of the interior of mold is very important because it in effect gives the "seed ice" a safe haven away from the warmth until the water temperature drops back down subsequent to the warming process. The "seed ice" then allows clean, clear ice to commence forming because the new ice has an attachment point. The formation of new ice can then continue until a full size item of crystal clear ice has been created. Without a sufficient amount of roughness of the mold interior, there is no attachment point for clear ice to begin forming.

To measure the degree of roughness of the molds, I use the same criteria used when measuring the coarseness of sandpaper. I prefer molds whose interior surface is between the roughness of 40 grit, which is very coarse, down to 1500 grit, which is quite fine. Roughness smaller than 1500 grit may not, in a manner of speaking, leave enough hiding room for the "seed ice." I have found that the equivalent of 200 grit works best for the purpose of making ice. Molds whose interiors are glass smooth are almost impossible to "de-slush" properly.

When making the basic mold to be used in the creation of flexible molds, the material I use, whether it is wood, concrete, plastic, or any other material, needs to have a suitable degree of roughness applied to the exterior surface thereof. This can be done using sandpaper with the roughness mentioned above. Once this is done, I may then mold with silicone, rubber or urethane, with this roughness directly copying from the original, basic mold onto the inside of the flexible mold.

I have found that many others attempting to create crystal clear ice objects by the use of non-metallic molds are not aware of the need to incorporate this roughness into the inner surfaces of the non-metallic mold, and I feel that this was a major stumbling block for those other people's efforts.

Although by the use of flexible molds I am able to create ice objects in a wide range of configurations, I prefer to create centerpieces that are spherical or substantially spherical in configuration. In most instances it is desirable for a centerpiece to last at least seven hours. Whereas typical ice sculptures typically only hold their shape for two to four hours, a spherical ice object does not lose its shape. After seven hours the original spherically shaped ice object will still be generally spherical, just smaller.

The ice object is spherical for a substantial extent of its outer surface, with the bottom portion of the spherical exterior gradually becoming a base of ice serving as the support for the object. What can be regarded as the skirt portion around the base of the object can be molded so as to have diamond cuts, waves, leaves, etc. molded into the ice. I prefer for the ball of ice to extend down from the top for at least 90 degrees, to no more than 140 degrees before the base starts. In most instances I utilize a ball or sphere that curves from the top down to approximately 125 degrees before the base of the ice object commences.

By now it should be clear that if the slush occurring in a mold is properly thawed back into its liquid form just above its freezing point, in the range of 32° F. to 35° F., the slush is not only eliminated, but most significantly, slushing will not recur. In other words, if a proper amount of warming is induced into the slushed water, such as by pouring in a correct amount of warm water or adding a warm object, when refreezing of the water in the mold takes place, it will occur without slushing and crystal clear ice will form properly and evenly on the inner sides of the mold. A proper amount of warming may be represented by the amount of room temperature water that melts the crystals aimlessly floating in the center portion of the mold, but not melting the seed crystals that have attached to the inner roughness of the mold.

If the desired warming of the contents of the mold is brought about in a carefully controlled manner by the addition of a small quantity of relatively warm water, it is obvious that the level of water in the mold will become higher. For this reason, it is quite desirable to utilize a mold support level altering device such as a plurality of notches on each side of the chiller tank so that elongate rods, if utilized for supporting the silicone molds, can be repositioned heightwise as circumstances warrant. As an alternative to changing the height of the mold with respect to the surface of the chilling solution, it is also be possible to change the fluid level of the chilling solution in the tank by any of several convenient means. These include adding liquids or solids to the chilling solution, or as one particularly attractive alternative, inflating a submerged bladder to a selected extent by the use of compressed air so as to displace a desired amount of space within the chilling solution.

Although the workman or attendant needs to be initially concerned with a sufficient amount of water being contained in each mold, such that the mold will expand out into its intended configuration, and/or that the mold be located at the correct elevation with respect to the chilled solution, after ice has started to form, the workman need not be any longer concerned in this manner inasmuch as the forming ice will hold the mold in its intended configuration.

It is therefore a primary object of my invention to provide method and apparatus enabling crystal clear ice objects of intricate configuration to be created at a low to moderate cost.

It is another object of my invention to provide novel method and apparatus enabling crystal clear ice objects of intricate configuration to be created by the use of flexible molds, the use of which entails, however, the utilization of a special technique in view of the poor thermal conductivity and inherent movement within the flexible mold material.

It is still another object of my invention to provide novel method and apparatus enabling crystal clear ice objects of intricate configuration to be created by the use of flexible silicone-like molds, the use of which molds require a special technique involving a deliberate initial thawing of the first formed ice or slush, thus to bring about, at the time of refreezing, crystal clear ice free of imperfections.

It is yet still another object of my invention to provide a novel apparatus for supplying controlled amounts of a suitable gas, such as air, to cause circulation in each of a series of flexible molds partially immersed in a tank of chilled liquid, in which molds, intricate ice objects are being created, with this apparatus involving in one embodiment, the use of a relatively small supply tube for supplying controlled amounts of air or gas to each mold. Each gas supply tube is movable longitudinally as well as rotationally with respect to the supporting means for such tubes, thus to permit the operator to cause gas to be supplied to whatever location happens to be the most appropriate location in a given mold for the desired circulation.

It is yet still another object of my invention to provide a novel support arrangement enabling a number of sturdy, elongate rods to be utilized for supporting one or a plurality of flexible, water-containing molds at an appropriate depth with respect to the surface of the liquid contained in a chiller tank, such support arrangement permitting the operator to readily reposition, when necessary, the height of the flexible molds with respect to the surface of the chilled liquid, such that the level of water in each mold will at all times be somewhat higher than the level of the chilled liquid into which the closed lower end of each flexible mold is immersed.

It is yet still a further object of my invention to provide a novel support arrangement enabling a number of sturdy, elongate rods to be utilized with regard to the support in a chilled tank of one or a plurality of flexible molds of intricate configuration into which water has been poured, with such rods utilized in conjunction with a series of pipes and tubes for supplying controlled amounts of gas, such as air to each of the molds, with the rods and the pipes being supported from upper edges of the tank, with the height of the rods being adjustable and the location of the gas emanating from the supply tubes being controllable such that suitable amounts of gas will be caused to rise up through the water contained in each of the molds, thus inducing circulation to prevent the formation of cloudy ice.

It is yet still another object of my invention to provide alternative embodiments of my novel method and apparatus, such that crystal clear ice objects of intricate configuration can be created as a result of circulation induced into each flexible mold by mechanical means, with needed changes in the level of the chilled liquid in the tank being accomplished by changing the volume of a selectively inflatable bladder submerged in the tank, with the use of the bladder making it unnecessary for an attendant to reposition the elongate rods used to support the molds with respect to the level of the chilled fluid in the tank.

These and other objects, features and advantages will become more apparent from a study of the appended drawings.

BRIEF DESCRIPTION OF THE DRAWINGS

FIG. 5 is a representation of a crystal clear ice object made in a substantially spherical configuration and containing a bouquet of flowers, this being particularly suitable as a centerpiece for a banquet table or the like;

FIG. 7 is a fragmentary portion of a flexible mold generally along the lines of the mold depicted in FIG. 6, with this figure illustrating that the interior of the mold has a desirable amount of roughness;

FIG. 8 is a fragmentary portion of a flexible mold depicting the commencement of the formation of a thin layer of ice along the interior surface of the mold;

FIG. 9 is a fragmentary portion of a mold showing the buildup of a thickness of ice on the interior of the mold to the approximate thickness of one inch, at which time a bouquet of flowers or the like may be inserted so that it will thereafter be incorporated into the ice object;

FIG. 10 is a view similar to FIG. 9 but showing that instead of a bouquet of flowers, a logo can be inserted so as to be incorporated into the ice object;

FIG. 15 is a view generally along the lines of previous views relating to the support of a vertical adjustment device, but here revealing an arrangement whereby a flower, plaque or the like can be supported in a lower portion of a mold, such that it will become incorporated into the ice;

FIG. 16*a* is a fragmentary view, to a larger scale, of a typical shaft support device of the type depicted in FIG. 16, with it to be noted that the horizontally extending hole is laterally offset from the vertically extending hole in which a rotatable shaft is accommodated;

FIG. 16*b* is a fragmentary view, to a comparatively larger scale, of a typical pulley of the type depicted in FIG. 16, which pulley is to be mounted in a slidable manner on a splined shaft.

DETAILED DESCRIPTION

Figures 1, 1A:
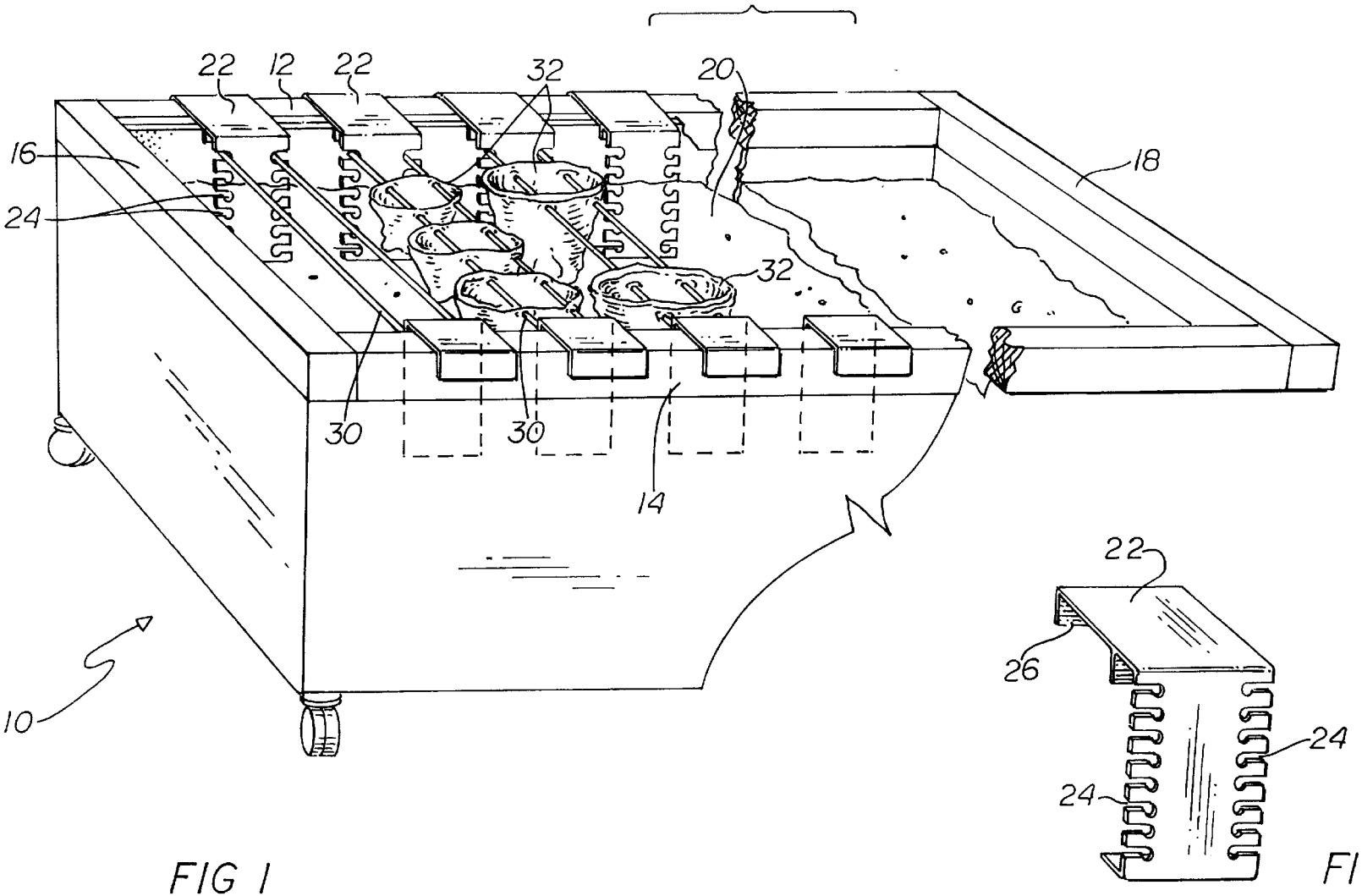
FIG. 1 is a perspective view, partially broken away, of a chiller tank of a type utilized in accordance with this invention, with this figure revealing the use of a number of elongate rods utilized for the support of a plurality of flexible molds in which water has been poured, with these rods being enabled to support the molds in an appropriate relationship with respect to the surface of the liquid of the chiller tank by virtue of the utilization of notched support brackets.
FIG. 1*a* is a perspective view to a somewhat larger scale of a typical notched support bracket of the type utilized for supporting one end of one or more elongate rods.

With initial reference to FIG. 1, it will be noted that in this exemplary embodiment of my invention, I have depicted a chiller tank 10 designed to contain a chilled liquid such as glycol, a brine solution, or in some instances, still another chiller substance. In the bottom interior portion of the tank is disposed a suitably configured pipe array, not shown. Through this pipe array, a refrigerant such as Freon is caused to circulate in order to maintain the chilled liquid at a desirably low temperature, such as between 5° F. and 20° F. A suitable pump (not shown) is utilized to circulate the glycol chilled by the pipe array so that it will maintain a desirably low and consistent temperature throughout the interior of the tank.

The tank 10 has long side walls 12 and 14, and end walls 16 and 18, with these walls being of a height such that the chilled liquid can be maintained at a suitable depth for the proper immersion of the flexible molds in which crystal clear ice structures are to be created in accordance with this invention. By way of example, the chilled solution may be maintained in the tank at a depth between 20 and 30 inches, but obviously this is not a requirement. The preferred liquid level 20 in the tank indicated in FIG. 1 is approximate only, and I am not to be limited to the illustrated arrangement.

Also visible in FIG. 1 are support means in the form of a plurality of generally L-shaped brackets 22 of substantially identical construction, with a typical bracket being illustrated in some detail in FIG. 1*a*. It will be noted that each bracket 22 contains on each of its long sides, a series of consistently spaced notches 24 that are associated with the suspension of the water-filled molds in the chiller tank. A rear portion 26 of each bracket 22 enables each bracket to be hooked over the edge of one of the long sidewalls of the tank and be maintained in a stable relationship therewith. The brackets 22 may be readily moved in a lateral direction along the tank sidewalls as may be necessary or desirable.

As shown in FIG. 1, elongate support means in the form of several pairs of sturdy rods 30 extend across the width of the tank 10, spanning between the long sides 12 and 14 of the tank. I prefer to utilize stainless steel in the construction of the elongate rods but I obviously am not to be limited to this. The notches 24 of each bracket are sized so as to receive the ends of the rods, with each rod supported from a certain notch 24 of one bracket being also supported by a notch 24 of the opposite bracket disposed at the same height. In this way, each elongate rod 30 can be supported in a parallel relationship to the surface of the chilled liquid in the tank 10.

As shown in a mid portion of FIG. 1, a given pair of rods 30 can support a plurality of flexible molds 32 into which a suitable amount of room temperature water has been poured. For example, I show three of the flexible molds being supported from the pair of elongate rods 30 nearest the end 16 of the tank, whereas from the pair of elongate rods nearer the end 18 of the tank, only two of the somewhat larger flexible molds are supported. As is obvious, more than two elongate support rods may be required in the event a mold of substantial dimension is to be supported.

Figure 2:
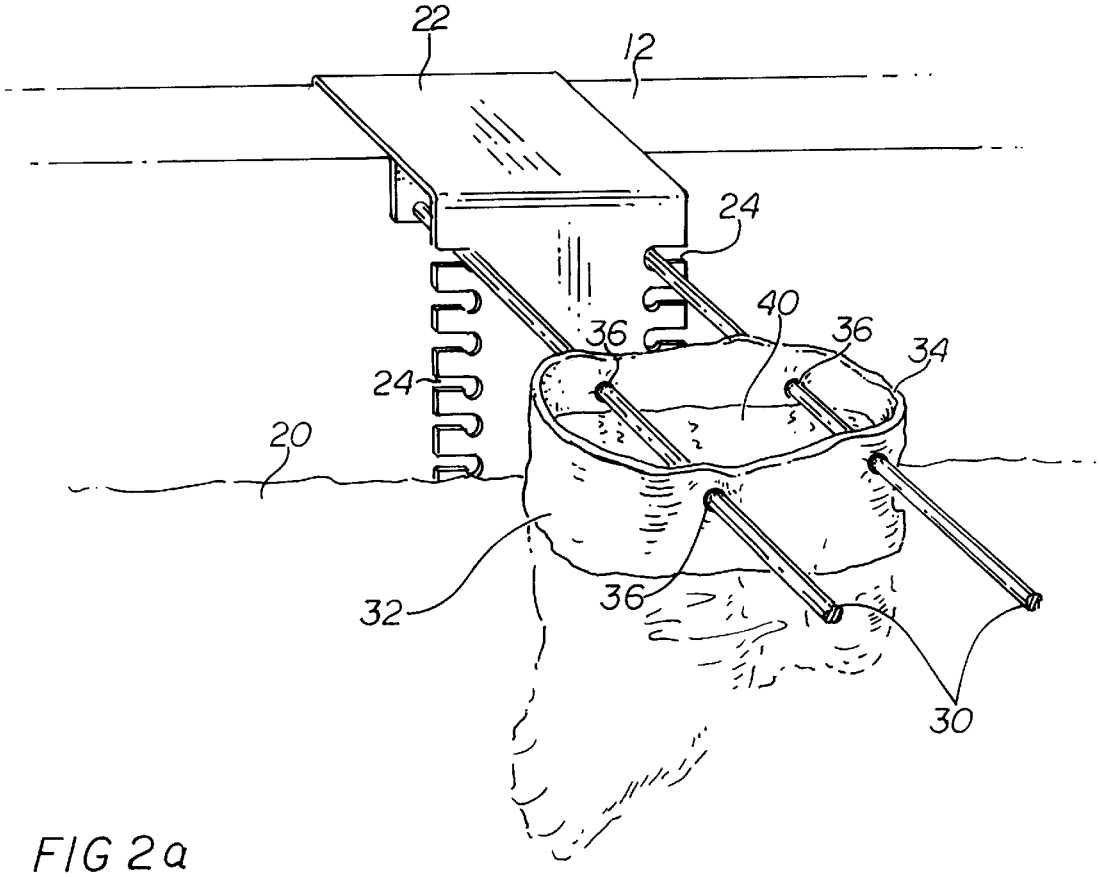
FIG. 2 is a perspective view to a still larger scale, in which significant details are revealed of the specific arrangement preferably used for the support of one type of flexible mold, such that the closed lower end of the mold will extend to a desired depth into the chiller liquid of the tank.

With reference to FIG. 2, it will here be seen in greater detail, the particular support arrangement I prefer to utilize for a flexible silicone type mold, with it to be clearly noted from this figure that the level 40 of the water inside the mold 32 is of a noticeably greater height than the level 20 of the chiller liquid utilized in the tank 10.

Figure 2A:
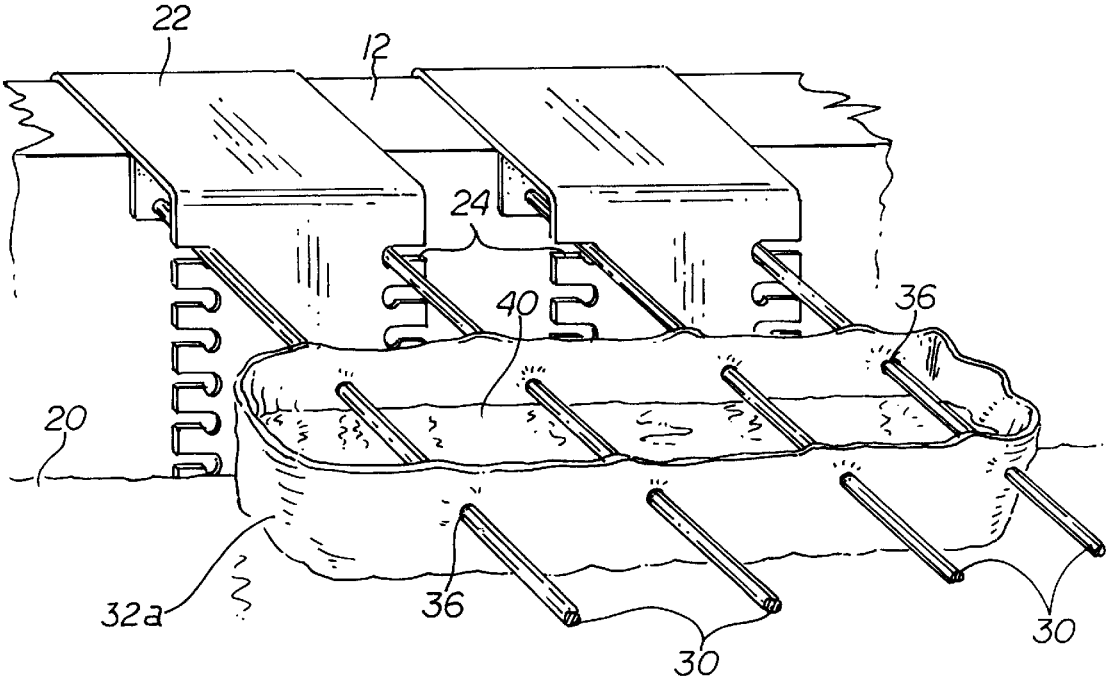
FIG. 2*a* is a perspective view closely resembling FIG. 2 but revealing how a flexible mold of substantial width is to be supported with respect to the surface of the chilled liquid, involving the use of more than two of the elongate rods.

In FIG. 2*a* I illustrate a flexible silicone type mold 32*a* of a rather substantial lateral dimension, which would obviously tend to sag if only two of the elongate rods 30 were utilized for supporting the mold. In this particular instance I illustrate a pair of the L-shaped brackets 12 being moved into a relatively close relationship, such that four elongate rods 30 rather than just two rods can be utilized for supporting this rather wide mold. It is to be noted, however, that four rods are not necessarily required when two closely placed brackets 22 are utilized on each side of the tank for supporting the rods of a given mold. For example, if the flexible mold were of less lateral width than the one depicted in FIG. 2*a*, it might well be possible to utilize only three rods in the support thereof, with two sets of notches 24 of one bracket being used, but only one set of the notches 24 of the other bracket being utilized. It is obvious that the operator will need to use judgement in the placement of the brackets such that the flexible molds will be supported in an apt manner, with the elongate rods in a substantially parallel relationship to the surface of the chilling liquid contained in the tank.

Because of the utilization of the series of equally spaced notches 24 in each bracket 22, it is readily possible, in accordance with this embodiment of my invention, for the operator to dispose a given pair of rods 30 in a wide range of height relationships with respect to the liquid level 20 of the chiller liquid. By way of example, the inside width of the tank can be 34", the rods 33" long, and the distance between notches 24 on opposite sides of the tank can be 32". Quite clearly, these measurements are merely exemplary of one particular embodiment of my invention, and I am obviously not to be limited to these measurements.

The operator must be mindful of the depth of the water in each mold 32 and the relationship of the mold to the level 20 of the chilled liquid in the tank 10. This is important because there must be sufficient water in each mold for the hydrostatic pressure of the water to cause the mold to expand out into the desired configuration. More particularly, inasmuch as the molds are relatively light and of relatively soft texture, there must be enough "head" of water in a mold as to overcome the tendency of the chilled liquid to cause the sidewalls of the mold to move somewhat inwardly. As is obvious, the higher the specific gravity of the chilled liquid, the higher the desired head of water in each mold.

With continuing reference to FIG. 2, it will be noted that the open upper portion 34 of a typical mold 32 extends well above the level 20 of the liquid in the chiller tank, whereas the lower, principal portion of the mold extends for a relatively substantial distance below the surface of the level 20 of the chilled liquid. It will be noted that four rod-receiving holes 36 are utilized in the upper portion 34 of this mold. For obvious reasons, I place reinforcement in the upper portion 34 so that the weight of the water added to the mold 32 will not cause tearing of the holes 36 during the time the molds are substantially full and being supported from a pair of rods 30.

It will be noted in FIGS. 2 and 2*a* that I have shown the water level 40 in the molds 32 and 32*a* to be somewhat higher than the liquid level 20 of the chiller solution in the tank 10. As mentioned above, a height of water in each mold greater than the height of the chilled liquid assures the mold expanding out into the configuration desired.

It is to be seen that the provision of the plurality of notches 24 in the brackets 22 makes it readily possible for the operator to move, in accordance with this embodiment of my invention, the plurality of molds 32 to the height most appropriate to the liquid level 20 in the tank 10. If more water is added to the molds during the procedure of creating the ice sculptures, it may well be desirable to move the rods 30 to notches 24 that are lower on each bracket, or in other words, to notches that are disposed somewhat deeper on the sidewalls of the tank. This is because the chilled liquid will freeze no more than ½" to 1" of the water in the mold that is above the glycol level. As one example, if there were four inches of head water above the glycol level, it is likely that three inches of that water in the mold would remain unfrozen.

As will be discussed hereinafter, I am not limited to the utilization of notched brackets for enabling the operator to reposition the elongate support rods in a heightwise manner. By employing an inflatable bladder mounted at or near the bottom of the chiller tank, as described in connection with FIG. 17, the operator can readily change, to a desired extent, the level of the chilled liquid in the tank merely by modifying the degree of inflation of the bladder.

Figure 3B:
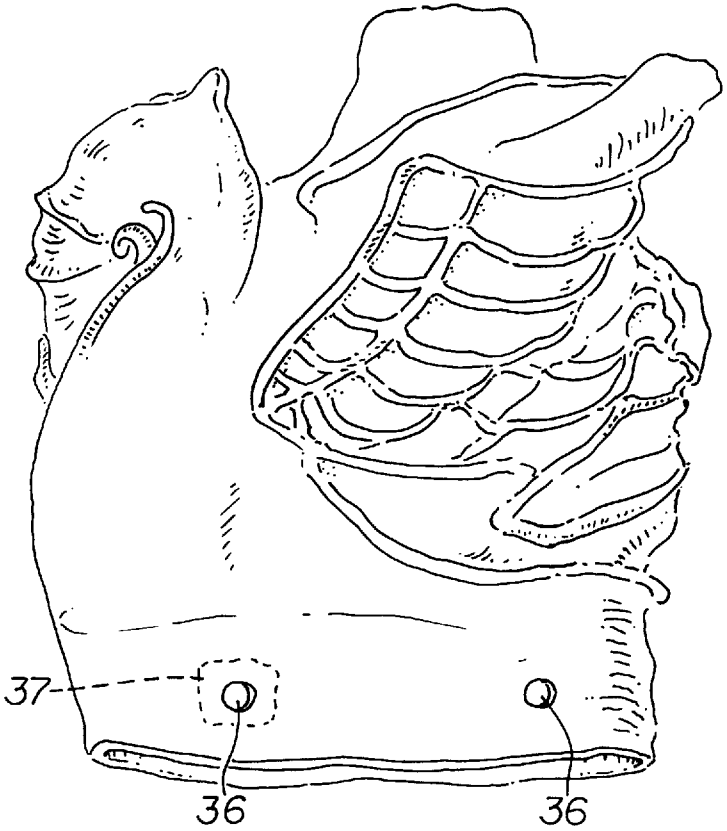
FIG. 3*b* is a view of the same mold as depicted in FIG. 3*a* except in this instance the mold has been turned inside out so as to reveal the intricate detail that is to be imparted to the ice formed in the interior of the mold.
Figure 3A:
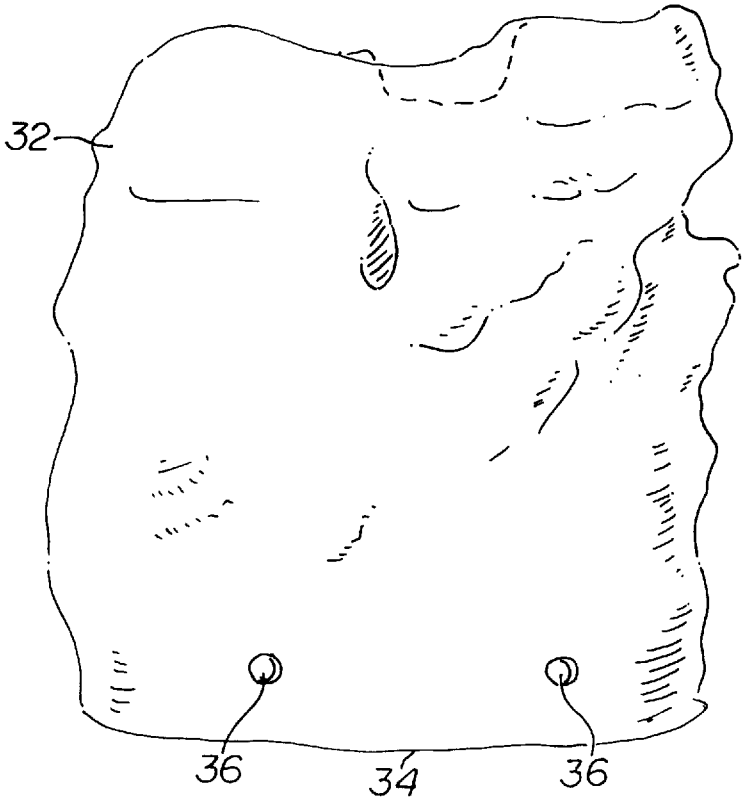
FIG. 3*a* is a view of the exterior of one type of flexible mold in accordance with this invention, which has been turned such that its open portion is directed downwardly.

Turning now to FIGS. 3*a* and 3*b*, in FIG. 3*a* I show the exterior of one of the silicone type molds that I utilize in certain instances, which mold has of course been placed in this instance such that its open side is down and its principal or closed portion upward. Although the mold exterior bears some resemblance to the ice object to be created, the exterior of the mold is understandably of a more gross configuration than the interior of the mold.

With reference to FIG. 3*b* it will be seen that in this instance I have turned the mold inside out, so as to show the fine detail including undercuts to be imparted to the ice object. As explained above, by keeping a sufficient "head" of water in the mold with respect to the level 20 of the chilled liquid, the mold will be forced by hydrostatic pressure into the configuration it is desired for the ice to take.

From FIG. 3*b* it will be noted that I have provided a distinct amount of reinforcement around each of the holes 36 through which the elongate rods are to be inserted. The silicone-like molds are typically constructed from laying up several different layers of flexible silicone-like material, so it is usually quite convenient to insert a strong piece of fabric 37 between the layers utilized at the upper portion 34 of the mold, thus to provide a desirable amount of strength to the upper mold portion.

It is important to note that I utilize flexible molds whose interior surfaces have a desirable amount of roughness, as discussed hereinafter with regard to FIG. 7. I have established that ice begins to form on the inner surfaces of a mold, and I wish to call this "seed ice." As the water in a mold continues to freeze, this "seed ice" enables future crystals to attach properly. Ice can build up to a desirable thickness over a period of several hours when utilizing molds with the proper amount of interior roughness, but the use of a flexible mold with very smooth internal surfaces makes the formation of "seed ice" almost impossible, therefore preventing the creation of crystal clear ice objects in accordance with this invention.

When utilizing metal molds, it can be reliably predicted that the water in the mold will begin to freeze in the region of 31° F. to 32° F. In contrast with this, when utilizing a water filled silicone mold employing a water circulating arrangement, which mold is suspended in contact with the surface of chilling solution maintained at some point below water freezing temperatures, I have found that freezing does not readily take place until a temperature of approximately 28° F. has been reached, and in some instances, a temperature as low as 26° F.

It is to be noted that when the super cooled water in a flexible silicone-like mold does begin to freeze, it suddenly freezes in a manner bringing about what I prefer to call "slushing." By this it is meant that whereas the water in the mold prior to slushing is clear and free of ice, it may in the next moment become cloudy with ice crystals which I refer to as slush. I have found that unless this slushing is eliminated, it will be impossible at this time to create crystal clear ice in this mold.

Most significantly, I have found that if the slush in the mold is properly thawed back into its liquid form just above its freezing point, in the range of 32° F. to 35° F., the slush is not only eliminated, but most significantly, slushing will not recur. In other words, if a proper amount of warming is induced into the slushed water, such as by pouring in a correct amount of warm water or adding a warm object, when refreezing of the water in the mold takes place, it will occur without slushing and crystal clear ice will form properly and evenly on the inner sides of the flexible mold. It has been previously mentioned that a proper amount of warming involves the elimination of the aimlessly formed ice crystals in the center of the mold, while avoiding elimination of the ice crystals, known as "seed ice," clinging to the rough interior surfaces of the mold.

If the desired warming of the contents of the mold is brought about in a carefully controlled manner by the addition of a small quantity of relatively warm water, it is obvious that the level of water in the mold will become higher. For this reason, it is quite desirable to utilize a mold support level altering device such as a plurality of notches on each side of the chiller tank so that elongate rods, if utilized for supporting the silicone molds, can be repositioned heightwise as circumstances warrant. As an alternative to changing the height of the mold with respect to the surface of the chilling solution, it is also be possible to change the fluid level of the chilling solution in the tank by any of several convenient means. These include adding liquids or solids to the chilling solution, or as one particularly attractive alternative, inflating a submerged bladder to a selected extent by the use of compressed air so as to displace a desired amount of space within the chilling solution. The bladder embodiment will be discussed in conjunction with FIG. 17.

More information will hereinafter be provided with regard to the procedure followed during the construction of the flexible molds I prefer to use in accordance with this invention.

Although as shown in FIGS. 3 and 3*a* I may create ice objects of various shapes, I have found it particularly desirable when creating ice objects for the centerpiece of a dining table or banquet table to create the ice object of essentially spherical configuration. The reason for this is that an ice object created in a spherical shape will remain in a spherical configuration for up to ten hours, thus maintaining a substantial amount of its attractiveness. This is in contrast with ice objects created in the configuration of animals or the like, which often become shapeless masses after being on display for only two to three hours.

Figure 4:
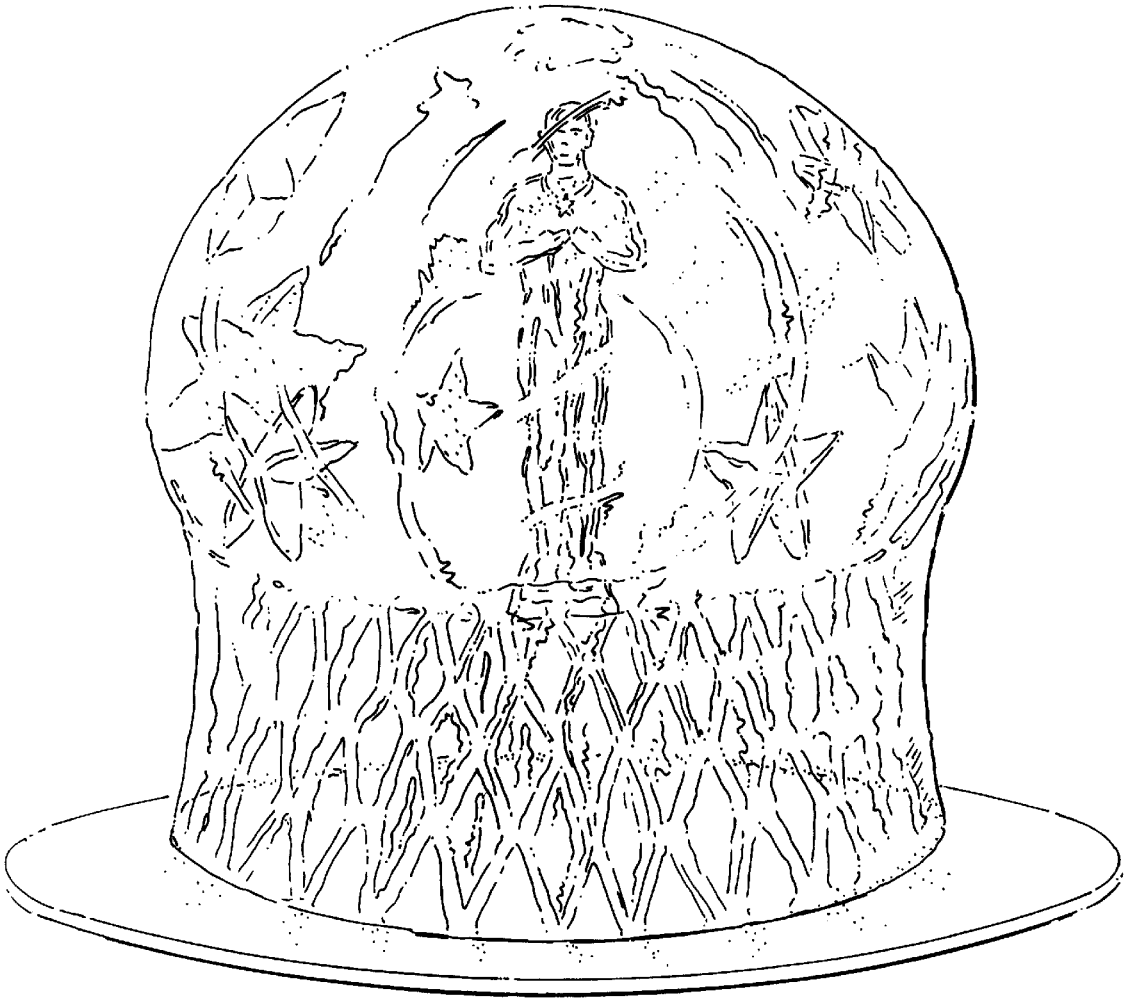
FIG. 4 is a representation of a crystal clear ice object made in a substantially spherical configuration and containing by way of decoration in its interior, a statue representing a human figure to be used, for example, in an awards banquet.

With reference now to FIG. 4, it will be noted that I have depicted an ice object whose upper portion is spherically-shaped, with only the base portion of this ice object being non-spherical. After ice has formed in the mold to a significant extent, an object to be incorporated into the ice object can be inserted directly into the top of the mold, after which the ice formation continues. In the instance depicted in FIG. 4, I have inserted a statue representing a human body, with it to be understood that depending on the specific event, the statue can take on the appearance of a bride, the honoree at a special dinner, or the like. Other decorations can of course be included.

Figure 5:
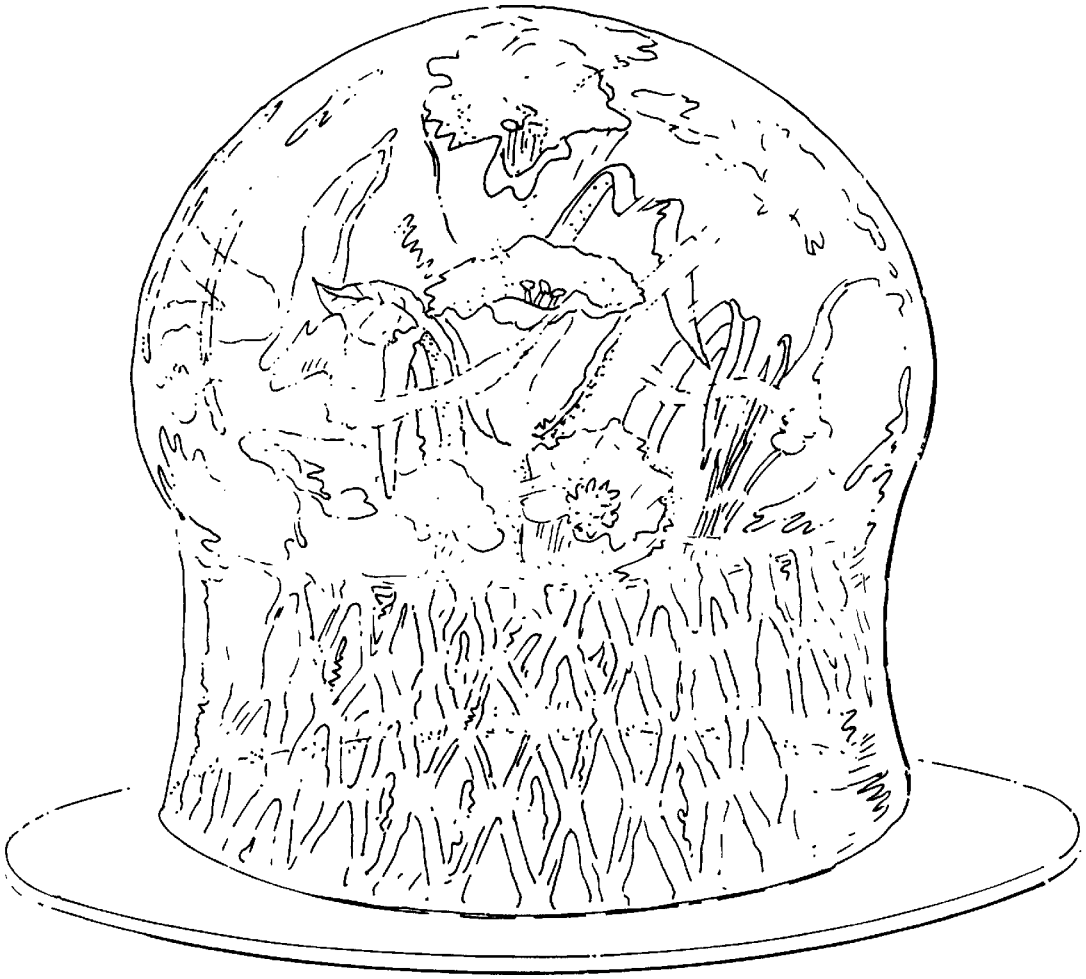

Turning now to FIG. 5, it will be seen that I have shown a spherically-shaped ice object quite similar to that depicted in FIG. 4 except that in this instance, a bouquet of flowers has been inserted into the open top of the mold after a significant amount of ice has commenced forming around the interior of the mold. The bouquet can of course be selected to be of a particular motif or color, with the spherical configuration of the ice object meaning that the display will retain its attractiveness for a protracted period of time.

Figure 6:
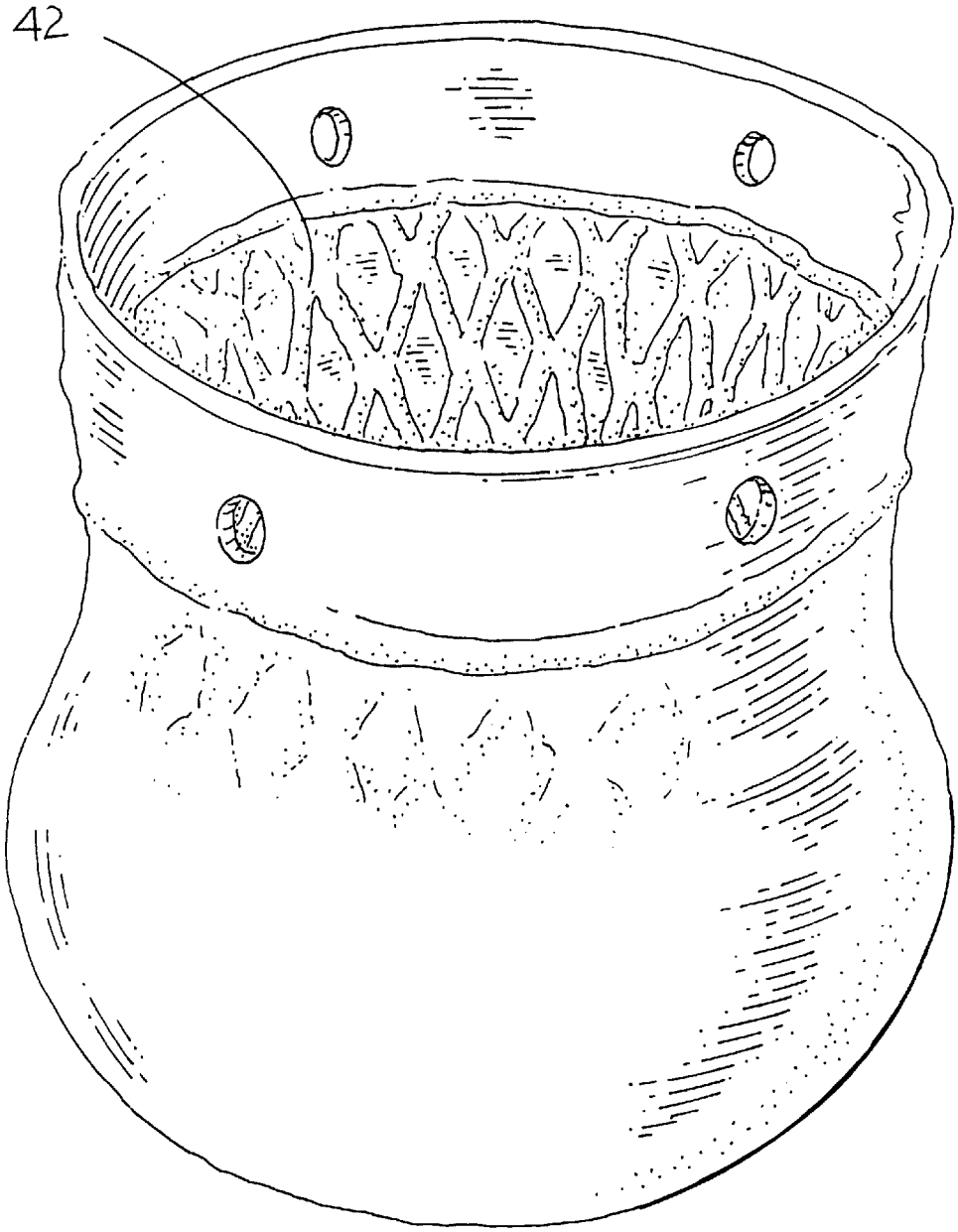
FIG. 6 is a view of the exterior of a typical flexible mold configured to create an ice object of substantially spherical configuration, with an upper interior portion of this mold containing distinctive markings relatable to the markings visible in the lower portions of FIGS. 4 and 5.

With reference to FIG. 6, it will be seen that I have shown a mold of the type utilized in order to create the essentially spherical ice objects depicted in FIGS. 4 and 5. The portion of the mold equipped with mounting holes has been strengthened so as to receive the elongate rods earlier described, and it will also be noted that between the mounting holes and the essentially spherical part of the mold, I have presented what may be regarded as the straight sided portion of the mold. In the interests of creating a display of attractive configuration, I may create a diamond-shaped pattern 42, or another ornamental pattern, that will prove to be attractive as well as to melt in such a uniform manner that the attractiveness of the display will be maintained over a period of many hours. By the sphere residing on the top of a cluster of leaves or upon simulated waves, the display usually becomes substantially more attractive than if a plain base is used.

With reference to FIG. 7, it will be noted that I have portrayed the inner surface of a typical flexible mold in accordance with this invention, such as the mold depicted in FIG. 6. In order for the incipient ice crystals to be able to adhere to the interior of the mold, I have found it desirable for the interior of the mold to have a certain degree of roughness, such as shown at 44 in FIG. 7. For example, the surface may vary from what may be compared with fine sandpaper to what may be regarded as coarse sand paper, or in other words, the roughness can vary between a grit of 1500 down to a grit of 40. However, I have found that a grit of 200 is preferable in most instances.

With reference now to FIG. 8 it will be noted that during de-slushing I have caused essentially all of the visible slush to disappear. However, the added heat is not sufficient to melt all of the ice in the mold, for tiny particles of ice remain in the rough interior portions of the mold. It is to be noted that the slight layer of newly-formed ice depicted at 46 in FIG. 8 is a reasonably close representation of the ice existing in the mold approximately five minutes after the de-slushing procedure. From this point on, crystal clear ice will form in the mold.

Turning now to FIG. 9, it will be seen that I have here represented a rather substantial buildup of ice in the interior of the mold, taking on a thickness on the order of 1" of ice after a period of approximately three hours. The mold at this point is ideal for the reception of an object to be displayed, such as the bouquet of flowers illustrated in this figure. After the insertion of the bouquet, the molding of the ice continues unabated. Ice is a poor conductor of heat, so the additional buildup of ice represented by the dashed line 48 will require on the order of 20 hours to form.

With regard to FIG. 10, it is to be seen that I am not limited to the insertion of a bouquet of flowers, and for example a medallion or logo can be inserted into the mold after the ice has built up to a thickness of 1" or so. As previously mentioned, after the insertion of the object to be displayed, the freezing procedure continues as before.

Returning now to the procedures involved in creating crystal clear ice objects, it was earlier indicated that substantially continuous amounts of compressed gas may be inserted for inducing circulation, such as by air delivered into the bottom of each mold. This is a preferred means for creating a desirable amount of circulation in each of the molds, in order that crystal clear ice objects will be formed.

Depending upon the scale of the ice production facility and the size of the individual chiller tank system, the procedures of supporting and filling as well as the operation involving raising and lowering the level of the chilling liquid can vary widely. In some instances, these procedures can be automatic or semi-automatic, and quite obviously I am not to be limited to the described procedures.

Figure 11:
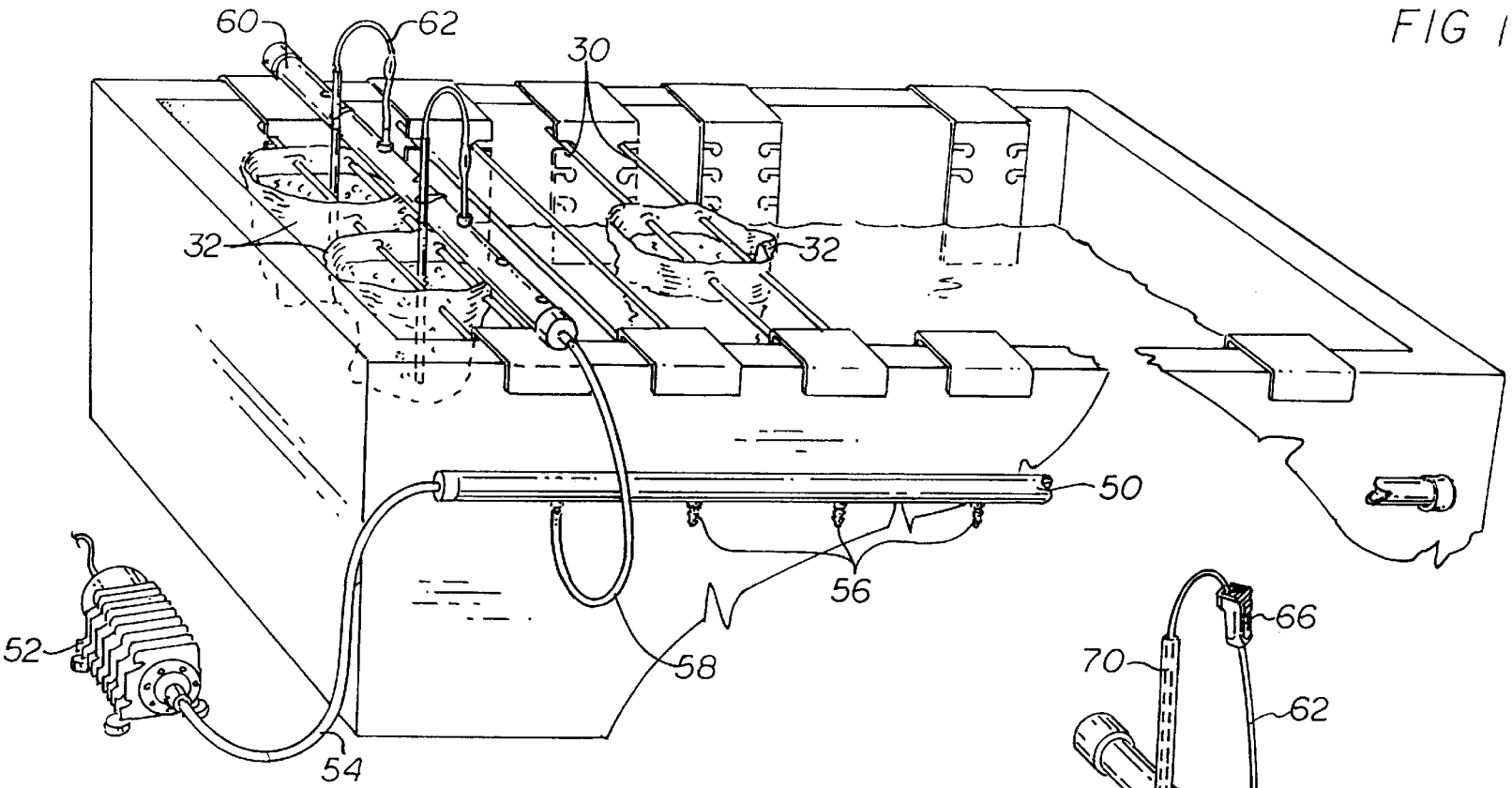
FIG. 11 is a perspective view of the chiller tank closely resembling FIG. 1 but containing additional equipment in that here I have indicated the manifold, the gas delivery pipe and the flexible gas supply tubing utilized in order that gas, preferably air, needed for the creation of crystal clear ice objects will be caused to bubble up in desirable quantity through the water contained in each of the flexible molds, with air being supplied in the instance of a small production system by the use of a relatively small air pump.

With reference to FIG. 11, it will be noted that, in this embodiment, I have also shown the use of the notched brackets making possible the heightwise repositioning of the elongate rods utilized in the support of the flexible molds in the proper relationship to the level of the chilled liquid in the tank. In FIG. 11 I have shown a main manifold 50 directly associated with the supply of compressed gas, such as air in appropriate quantity to each mold of the array of molds. The main manifold 50 is typically supported on the exterior sidewall of the tank, relatively near the top of the sidewall, but I am not to be limited to this arrangement. Utilized in this instance, in connection with the main manifold 50, is an air supply device, in this instance an electrically operated air pump 52 serving to deliver air at a suitable pressure and in sufficient amounts for the creation of crystal clear ice objects. It will be noted that a hose or tube 54 extends between the pump 52 and one end of the manifold 50. The other end of the main manifold is tightly closed.

If a gas other than air is used, I can of course connect the end of hose 54 to the outlet of the tank in which the compressed gas is contained.

A number of outlets or threaded nipples 56 are provided at spaced locations along the manifold 50, with it to be understood that a separate tube 58 is to be connected to each outlet or nipple so that air can be delivered to each of the flexible molds of a particular grouping.

It will be noted from FIG. 11 that I have shown an exemplary air delivery pipe 60, typically of PVC, that is of sufficient length as to extend across the width of the tank and to be supported from the opposite long edges 12 and 14 of the tank. Although not shown in this figure, it is to be understood that several air delivery pipes, each substantially identical to pipe 60, will be utilized on the tank 10, so that each grouping of molds can be provided with a suitable amount of air from the respective air delivery pipe 60.

Each air delivery pipe 60 is of relatively stiff construction, so as to possess sufficient strength for supporting a number of relatively small, flexible air tubes 62 utilized for supplying air to the several flexible molds of each grouping. However, the weight involved with respect to the air tubes is usually not particularly significant. As will be seen from FIG. 11, a separate flexible air supply tube 62 will be provided for supplying air to each mold supported from a given pair of elongate support rods 30.

Figure 12:
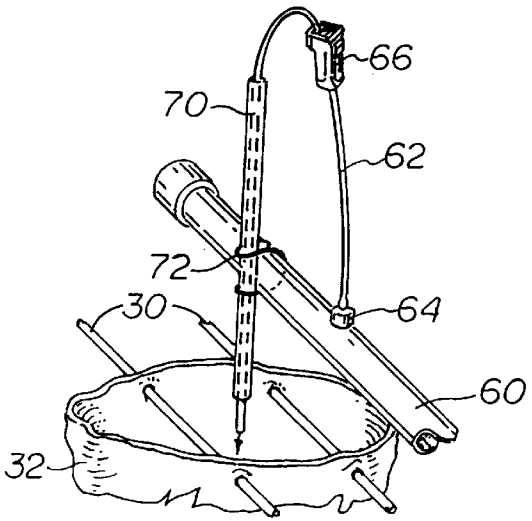
FIG. 12 is a perspective view to a larger scale of the use of a novel vertical adjustment tube affixed to the air delivery pipe in a manner permitting longitudinal as well as rotational manipulation of this tube with respect to the air delivery pipe, thus to permit the vertical adjustment tube to enable the relatively small, flexible air supply tubing to insert air into a desired lower location in each flexible mold of the array.

As shown in FIG. 11 but in greater detail in FIG. 12, the flexible air supply tube 62 connects to a respective nipple 64 affixed to the air delivery pipe 60. Inasmuch as it is highly desirable to be able to carefully modulate the flow of air into each of the flexible molds, I prefer to utilize in each of the flexible air supply tubes 62, a thumb-operated air adjustment device or shutoff device 66 of the type illustrated in detail in FIG. 12*a*. Although I am not limited to this precise type of air flow adjustment device, I particularly favor a device of this type in that by moving the wheel 68 of the device a relatively short distance, a fine grain modulation of the quantity of compressed gas flowing through the respective flexible air supply tube 62 can be brought about. It will be seen from FIG. 12*a* that if the wheel 68 is moved to the right as viewed in this figure, it serves to compress to a lesser extent, the flexible tubing 62 against an angled tube support surface, so as to permit an increase in air flow. On the other hand, if the wheel is moved in the opposite direction, which is to the left, this tends to increase the compressive force asserted against the flexible tube, and bring about a controlled diminishment of air passing through the flexible tubing 62. As is obvious, if the wheel is moved sufficiently far to the left, this will bring about a complete stoppage of air flow through the air supply tube 62 into the mold.

Because the tube material I utilize for supplying air to each of the molds is desirably flexible, an additional means is required for supporting each flexible air supply tube 62 in a desired relationship to the mold. With reference to FIG. 12, an exemplary version of a hollow support tube 70 is shown to be mounted on the air delivery pipe 60. Each hollow support tube 70 is relatively short, and it will be understood from reference to FIG. 11 that a series of these hollow support tubes 70 is mounted on each air delivery pipe 60. Each of these hollow support tubes is typically several inches in length, is relatively rigid, and has an inside diameter only slightly larger than the outside diameter of the flexible air supply tube 62 utilized therewith. Because of the role played by the hollow support tubes 70, I may also refer to them as pivotally mounted vertical adjustment tubes.

With continuing reference to FIG. 12, it will be seen that by the use of a flexible plastic tie-wrap 72, the vertical adjustment tube 70 has been attached at approximately its midpoint to the air delivery pipe 60 at a location closely adjacent the flexible mold to be supplied with modulated quantities of air. I deliberately utilize a flexible plastic tie-wrap or its functional equivalent so as to make it possible for the vertical adjustment tube 70 to be moved in a lengthwise manner with respect to the air delivery pipe 60. Importantly, each vertical adjustment tube is also intended to be moved, on occasion, in a rotational manner with respect to the air delivery pipe. This type of arrangement is preferably utilized for a purpose to be described shortly.

The flexible tie-wrap 72 binds the hollow vertical adjustment tube 70 sufficiently tightly as to make it possible for the operator to expect the respective vertical adjustment tube 70 to stay in the position on the air delivery pipe 60 into which it has been moved. Because each vertical adjustment tube 70 ordinarily stays fairly close to a vertical relationship with the air delivery pipe 60 and the surface of the chilled liquid in the tank 10, it forms a ready means for supporting the flexible air supply tubes 62 in the positions illustrated in FIGS. 11 and 12.

Because of this advantageous arrangement for supporting the flexible air supply tubes 62, it is possible for the operator to place the end of the flexible air supply tubing in a desirable location in the interior of the respective flexible mold such that compressed gas bubbling out of the lower end of the flexible air supply tube will travel a desired path upwardly through the water contained in the flexible mold. As previously indicated, this compressed gas brings about a desirable "sweeping" of the inside surfaces of the mold, and this is of considerable consequence in the creation of crystal clear ice objects of intricate configuration. As will be seen hereinafter, however, I am not to be limited to the use of compressed gas for inducing circulation, for certain mechanical means can be utilized for providing the desired continuous circulation of water in each mold.

Figure 13:
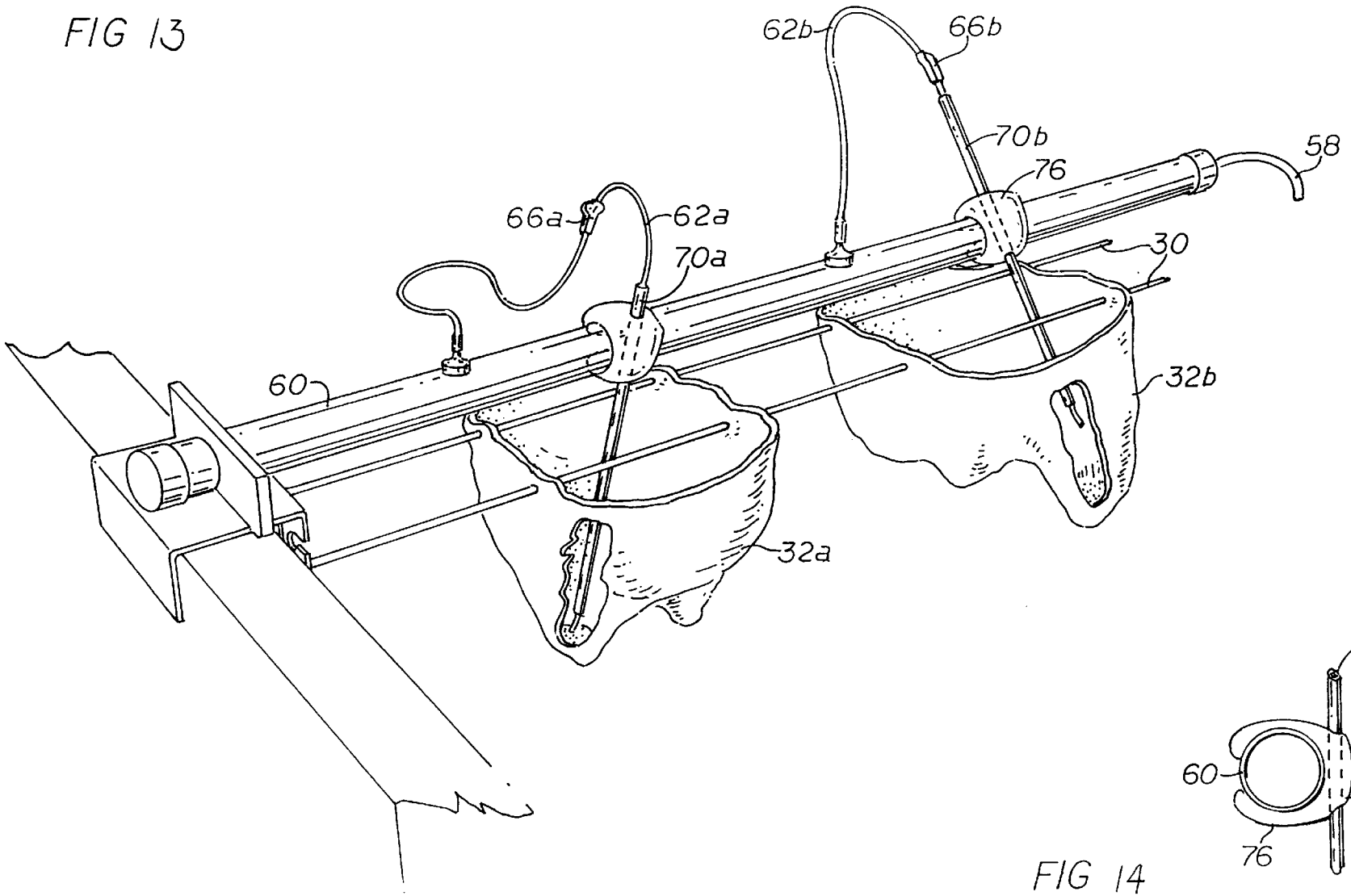
FIG. 13 is a view to a relatively large scale of a pair of flexible molds of differing configuration, with this view revealing the desirability of the vertical adjustment tubes being movable longitudinally as well as rotationally with respect to the air delivery pipe, with such versatility making it readily possible for the operator to cause a suitable quantity of compressed gas or air to be bubbled up from the flexible air supply tube through the water of each mold, with such air to be supplied at the "deep spot" of each mold.

With reference now to FIG. 13, it will be seen that I have shown to a somewhat larger scale, a pair of flexible molds 32*a* and 32*b* supported from an elongate pair of rods 30, and it will be noted that these molds were created in such a manner as to cause what may be regarded as a "deep spot" in each mold. This deep spot could for example represent the location of the head region of a swan, horse or the like that is to be created out of ice.

It will be noted in FIG. 13 that non-identical molds are involved, with the "deep spot" of mold 32*a* being at a different location than is the "deep spot" of the adjacent mold 32*b*. Inasmuch as it is ordinarily appropriate for air to be supplied to the "deep spot" of each mold, it is highly desirable for the operator to be able to move the vertical adjustment tube 70*a* to a different lengthwise extent than the vertical adjustment tube 70*b* also shown in FIG. 13. Because the molds 32*a* and 32*b* are of rather different configurations, it is necessary for the rotative orientation of the vertical adjustment tube 70*a* on the air delivery pipe 60 to be different from the rotative orientation of the vertical adjustment tube 70*b*.

As indicated hereinabove, the use of plastic tie-wraps is usually quite satisfactory in that on the one hand they provide sufficient strength, but on the other hand they permit the operator to accomplish the above-described longitudinal as well as rotational movements of the vertical adjustment tubes with respect to the air delivery pipe, so that air will be supplied to the most appropriate location of each mold.

Figure 14:
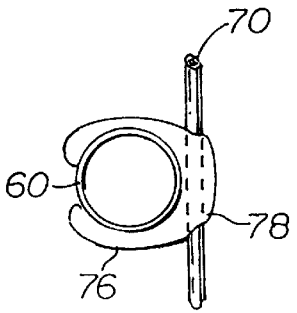
FIG. 14 is a fragmentary view of one type of device I may utilize for supporting a vertical adjustment tube from the air delivery pipe in a manner permitting a wide range of adjustments.

Obviously I am not to be limited to these flexible plastic tie-wraps, for in FIG. 14 I show a "C-shaped" component 76 utilized for attachment to the air delivery pipe 60, with a slot 78 being provided in the C-shaped component 76 into which one of the vertical adjustment tubes 70 can be readily installed in a slidable manner. The component 76 is rotationally movable on the air delivery pipe.

It is to be understood that each flexible mold supported in appropriate contact with the chiller liquid of the tank by the use of two or more elongate rods 30 is to be supplied on a substantially continuous basis with air in a desirable quantity. It is also to be understood that inasmuch as the configurations of the relatively numerous flexible molds being used at a given time in the chiller tank can vary widely, it is quite necessary to make it possible for the operator to cause the insertion of air into the appropriate location in each mold, typically at the "deep spot" of each mold. This is of course accomplished in a very convenient and effective manner by providing the above-described vertical adjustment tube 70 in connection with each mold, which vertical adjustment tube not only provides a support for the respective air supply tube 62, but also permits the operator to dispose the outlet end of each flexible air supply tube 62 at the most desirable location in the interior of the respective flexible mold. In other words, flexible air supply tube 62*a* is typically maintained in the deep spot of flexible mold 32*a*, and flexible air supply tube 62*b* is typically maintained in the deep spot of flexible mold 32*b*. Importantly, neither of these flexible air supply tubes fits so tightly in its respective vertical adjustment tube 70*a* or 70*b* as to inhibit movement therein of the air supply tube.

Figure 12A:
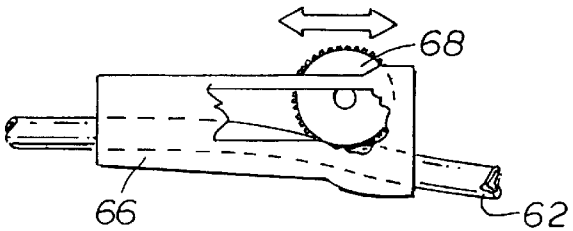
FIG. 12*a* is a view to a substantially larger scale of a typical hand manipulated air flow control means of the type provided for the convenience of the operator, enabling the operator to readily modulate the amount of air permitted to flow through each flexible air supply tube utilized with the molds of the array.

Furthermore, by providing a thumb-operated air flow control adjustment device 66 of the type shown in FIG. 12*a*, it is obvious that it is readily possible for the operator to carefully modulate, by appropriate rotation of the small wheel 68, the amount of air being permitted to flow through the air supply tube 62 and bubble up through the water of each mold during the time the mold is being chilled. As is also obvious, an amount of air desirable to be added in one instance or circumstance may be substantially different from the amount of air desirable in a different instance or circumstance, so the use of a relatively inexpensive air flow adjustment device 66 of the type shown in FIG. 12*a*, permitting fine grain control of the air flow, is highly desirable. Alternative devices of this general type may of course be substituted if such for any reason becomes necessary.

Presuming that the flexible molds have been filled with a suitable amount of water, it will perhaps be helpful to describe the creation of relatively small crystal clear ice objects with respect to an assumed time line.

8:00 AM The operator adds some additional water to each mold to bring to desired level.

8:05 AM An air supply tube 62 is inserted into the deep spot of each mold, typically within one inch of the bottom of the mold.

8:30 AM Operator notices that the condition previously described as "slushing" has occurred.

8:31 AM Warm water is added to de-slush, that is, to cause the slushing to disappear from each mold in which it has been forming.

8:35 AM Proper ice begins to form on the inner sides of each mold that has been de-slushed.

9:35 AM The air tube 62 is pulled one inch higher off the bottom of each mold.

10:35 AM The support tubes 70 (vertical adjustment tubes) are also pulled another inch higher, which causes the air supply tubes 62 to also move upwardly a like amount.

3:30 PM Air supply rods removed and the molds are removed from the chiller bath.

3:35 PM Ice is removed from the flexible molds and placed in the freezer for storage. The flexible molds are reusable for a large number of times.

The foregoing represents an appropriate timetable when utilizing miniature molds, such as of swans or the like. However, if relatively large flexible molds are involved, each having for example a 10" internal diameter, the support tubes 70 mentioned above as being pulled an inch higher at 10:35 AM are likely moved another inch higher again at say 2:30 PM. Continuing with regard to the utilization of 10" spheres, the support tubes are likely moved two more inches higher again at 5:00 PM. Molds of this size will likely be permitted to remain overnight in the chiller tank, not to be demolded until the next morning.

It is to be understood that while a desired amount of circulation in the interior of the molds is desirable, even before slushing, circulation is particularly important after slushing if the formation of tiny bubbles in the ice object is to be avoided. I have found that when the procedure involving the formation of ice objects is allowed to continue while the equipment is unattended, such as overnight, if electric power has gone off at any time during the lengthy procedure such that circulation in the mold is caused to cease, even for a short while, this fact will be evident from the presence of at least some tiny bubbles in the ice object. On the other hand, if circulation is continuously provided, the ice object will be crystal clear and contain no bubbles.

With regard to a different aspect of my device, it will be noted in FIG. 15 that instead of the vertical adjustment device 80 being in the form of a tube, it can instead involve a construction in which a clasping means 82 is mounted at the bottom. The vertical adjustment device 80, as in the case of the vertical adjustment tubes, can be moved longitudinally with respect to the air delivery pipe 60 as well as rotationally, thus to enable the lower end of the device 80 to be positioned at a desired location in the interior of the mold. It will be noted that the water level 40 in the mold 32 is higher than the liquid level 20 in the tank.

The purpose of the arrangement depicted in FIG. 15 is to enable a flower, a plaque, or some other appropriate item to be positioned in the mold, such that when the ice has formed, the flower, plaque or other item will be displayed in a highly desirable location. As is obvious, it is not desirable for the lower end of the vertical adjustment device 80 to become incorporated into the ice, so it is important for the operator to sense when the forming ice has commenced the support of the flower, plaque or the like, so that at that time the vertical support device and its clamp 82 can be removed.

It is of consequence to a full and complete comprehension of this invention to gain an appreciation for the typical way in which the flexible molds used with this invention are created. In the typical instance, a craftsman makes an exact original of the item to be reproduced in ice. This original can be constructed of urethane foam, Styrofoam, clay, wood, or other suitable type of workable material. After completion, the original is covered with a molding material such as a liquid urethane or the like, which is a material that hardens into a fairly thick, reusable flexible mold.

After hardening has taken place, the hand crafted flexible mold is separated from the original. It is to be understood that the interior of the fairly thick flexible rubber mold represents an exact copy of the handcrafted piece, and is often referred to as the "mother mold."

A suitable cementitious material such as Hydrocal is now poured into the mother mold so as to completely fill it. After the cementitious material has been allowed to cure, it is removed from the mother mold, with it to be understood that the mother mold is then used to make as many additional cementitious copies as are foreseen to be necessary, keeping the production schedule in mind. The molds of cementitious material, such as Hydrocal, represent a highly effective means by which a number of flexible silicone or rubber molds can be successively created, each as a substantially exact copy of the original handcrafted piece.

Using a brush, a plurality of layers of silicone or rubber-like molding material are now painted upon each Hydrocal copy until a desired thickness has been attained. Three or four coats are typically applied, until a mold having a thickness of between ⅛ inch to ¼ inch has been created. It is highly advantageous to create a number of cementitious copies from the mother mold inasmuch as each flexible silicone or rubber mold takes many hours to cure, and in many instances it is highly appropriate for a number of these flexible molds to be curing at the same time.

Continuing with these newly created flexible molds, inasmuch as the lower ends of the flexible molds are to be suspended to a suitable depth in the tank containing the chilled liquid by the use of the long thin support rods 30, I find it desirable in each instance to create, as previously mentioned in connection with FIG. 2, a sturdy upper mold portion 34 through which rod-receiving holes 36 can be formed. To prevent tearing, I typically insert one or more layers of tough fabric into the upper portion 34 during the layup. Also, I may create one or more index marks or marker devices on the interior of the mold, to act as a guide for the operator during the time that water is being poured into the mold.

It is apparent that the silicone mold I create upon each Hydrocal copy must be of a character and thickness sufficient to maintain a desired configuration, but not so thick as to make it difficult for the mold to be removed from a completed ice object. As indicated above, this thickness is usually ⅛ to ¼ inch.

It is obvious that the use of the flexible silicone molds 32 is highly advantageous, for not only do they make it possible to create intricate objects of crystal clear ice, but also they are reusable for several dozen times before they should be scrapped. Unfortunately, however, there is at least one disadvantage associated with the use of the silicone molds in that water does not begin to freeze at 32° F., as almost always takes place when metal molds are used. The reliable, highly accurate temperature measuring devices I utilize reveal that ice usually does not begin to form in a silicone mold until a temperature of approximately 28° F. has been reached, even though the chiller liquid is maintained at a steady temperature in the range of 5° F. to 20° F. Quite surprisingly, the temperature in a mold 32 can get as low as 26° F. before ice begins to form.

When ice does begin to form, it usually starts to form suddenly in the manner previously described as "slushing." It has already been made clear that at one instant, there was virtually no ice in the mold, whereas a moment later, the mold is suddenly filled with rather mushy ice. Should conditions remain unchanged, there would be no realistic hope of obtaining a crystal clear ice object during this particular procedure.

It is most important to note that I have found that by adding a controlled amount of warmth to the water in the mold, the slushing will be caused to disappear, and most advantageously, crystal clear ice will thereafter start to form on the sides of the mold as the chilling continues. This addition of warmth to the interior of the mold should be carried out very carefully, typically bringing the temperature of the water in the mold to a temperature no higher than 35° F.

The preferred procedure for the addition of warmth to the water in the mold involves the operator pouring a carefully controlled amount of relatively warm water, such as water at room temperature, into the interior of the mold, which of course causes the water level in the mold to increase. At this point it may be desirable to move downwardly, the pairs of elongate rods 30 supporting each mold, as a consequence of the quantity of relatively warm water having been added to the mold. This of course is achieved by the operator selecting for rod support, a lower pair of notches in the bracket on one side of the tank, that are aligned with a corresponding lower pair of notches in the bracket on the other side of the tank.

As an alternative to the addition of relatively warm water to the interior of the mold or molds, I may find it advantageous to insert a heated metal rod or the like into the interior of the mold where slushing has commenced to form, in this manner thus to cause the slushing to disappear. Whatever way is selected, I have found that the addition of a carefully controlled amount of warmth to eliminate the slushing permits the preferred type of freezing procedure to thereafter continue, and to result in the formation of crystal clear ice.

It is to be understood that initially formed ice crystals serve as a starting point for the growth of additional crystals. I have found that the first one inch of ice will form within the first one to three hours, but the thicker the formation of ice, the slower the formation of additional ice becomes. This is because ice is a poor conductor of heat. Thus, the second inch of ice will take approximately eight hours to form, whereas the third inch of ice will likely require twelve hours to form.

It is to be realized that I am not limited to the use of compressed gas for bringing about a desirable amount of circulation in the suspended molds, for as mentioned hereinabove, I can quite effectively utilize other means for bringing about circulation of the water in the molds.

Figure 16:
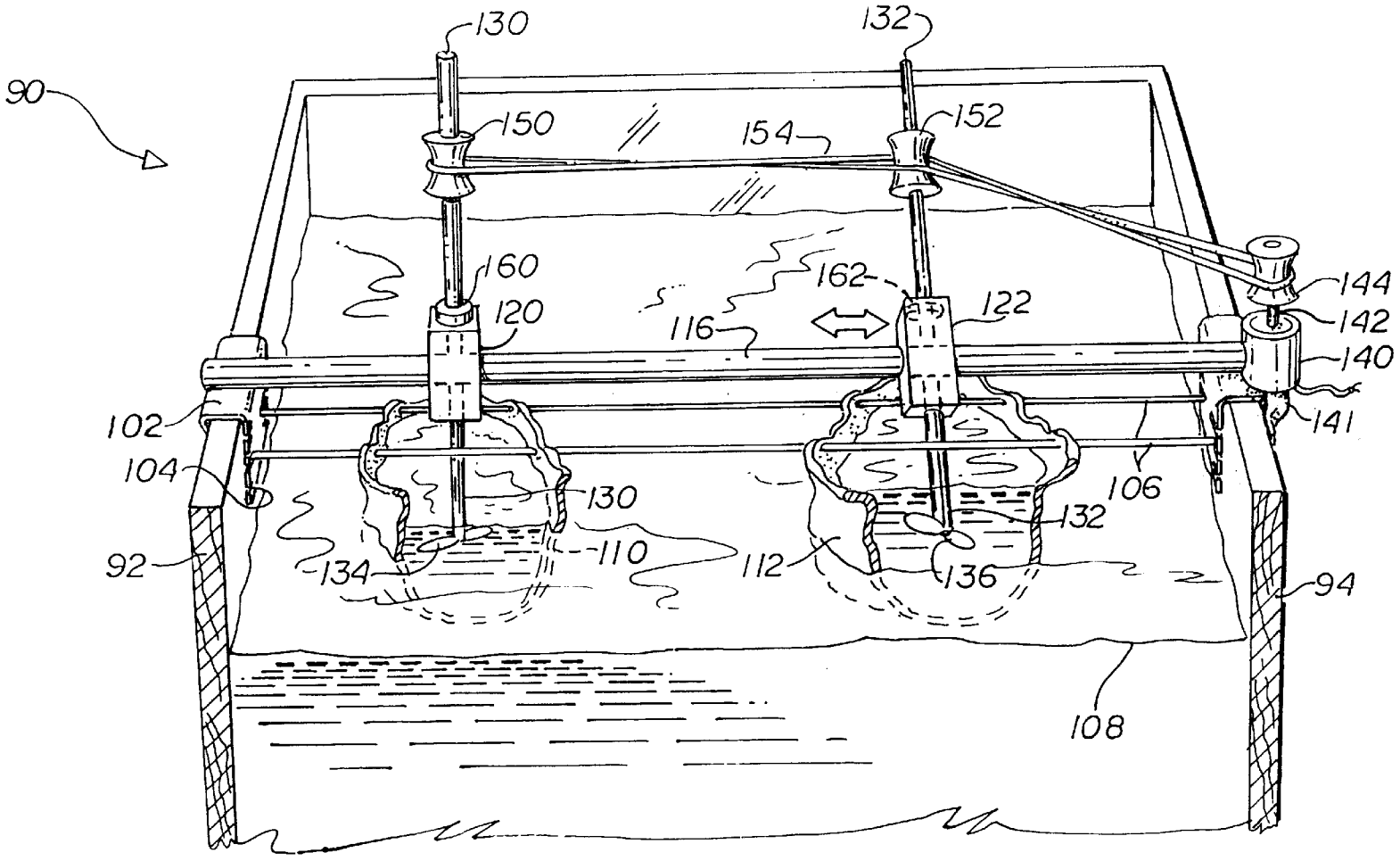
FIG. 16 is a frontal perspective view, partially in section, of a chiller tank configured to accommodate a substantially different embodiment of my invention, involving mechanical means in the form of a propeller or the like mounted on the lower end of a vertically disposed shaft that is driven in rotation in order to bring about a desired amount of circulation in each flexible mold of a mold array, thus to make possible the creation of crystal clear ice without necessitating the use of compressed gas.

With reference now to FIG. 16, I have there shown an embodiment of my invention in which a desired amount of circulation of the water in the flexible molds is obtained by mechanical means instead of by the use of a compressed gas, as in the previous embodiments. As revealed in FIG. 16, I have shown a tank 90 having sides 92 and 94, and containing a chilled liquid such as glycol, a brine solution, or in some instances, still another suitable substance. In the bottom interior portion of the tank 90 I may dispose a suitably configured pipe array (not shown) through which a refrigerant such as Freon is caused to circulate in order to maintain the chilled liquid at a desirably low temperature, such as 10° F. to 16° F. I may also optionally dispose in the bottom interior of the tank, an inflatable level-adjustment device, as will hereinafter be discussed in connection with FIG. 17.

With continued reference to FIG. 16, a suitable pump is typically utilized to circulate the glycol chilled by the pipe array so that it will maintain a desirably low and consistent temperature throughout the interior of the tank.

The long side walls 92 and 94 as well as the end walls of the tank 90 are of a height such that the chilled liquid can be maintained at a suitable depth for the proper immersion of the flexible silicone type molds in which the ice structures are to be created in accordance with this invention. As mentioned hereinbefore, the glycol or brine solution may be maintained in the tank at a depth between 20 and 30 inches, but obviously this is not a requirement. The preferred liquid level 108 in the tank indicated in FIG. 16 is approximate only, and I am not to be limited to the illustrated arrangement.

As was the case with the embodiment of FIG. 1, I may utilize support means in the form of a plurality of generally L-shaped brackets 102 of substantially identical construction, with each bracket containing on each of its long sides, a series of consistently spaced notches 104 that are associated with the suspension of the water-filled molds in the chiller tank. A rear portion of each bracket 102 enables each bracket to be hooked over the edge of one of the long sidewalls of the tank and be maintained in a stable relationship therewith. The brackets 102 may be readily moved in a lateral direction along the tank sidewalls as may be necessary or desirable.

As shown in FIG. 16, elongate support means in the form of several pairs of sturdy rods 106 extend across the width of the tank 90, spanning between the long sides 92 and 94 of the tank. The notches 104 of each bracket are sized so as to receive the ends of the rods 106, with the rods being supported from aligned notches so that each elongate rod 106 can be supported in a substantially parallel relationship to the surface 108 of the chilled liquid in the tank 90.

As shown in a mid portion of FIG. 16, a given pair of rods 106 can support a plurality of flexible molds into which a suitable amount of water has been poured. In this instance the pair of rods 106 support molds 110 and 112, whose lower (principal) portions extend down into the chilled liquid contained in the tank. It will be noted that the mold 110 is of a quite different configuration than mold 112. As previously explained, the water in the molds is deliberately maintained at a level higher than the level 108 of the chilled liquid in the tank 90. I rely upon the weight of the water in each mold being sufficient to cause the sides of the mold to fully extend.

Spanning across the top of the tank 90, and resting on the tops of the sides 92 and 94, is sturdy rod 116 of circular cross section, which is used for supporting the components associated with the mechanical devices I utilize for bringing about a desirable amount of circulation in the water in the molds 110 and 112. Slidably mounted on the circular rod 116 are mounting members 120 and 122 of substantially identical construction, with each of these members being provided with a horizontally extending hole through which the circular rod 116 extends. The members 120 and 122 are preferably constructed of industrial grade plastic, with the members fitting closely upon the circular rod 116. The fit is not so close as to prevent the user moving the mounting members 120 and 122 along the circular rod 116 to desired locations, nor so tight as to prevent the user bringing about some rotation of the mounting members 120 and 122 with respect to the circular rod 116. However, the fit is close enough that when a member 120 or 122 has been moved longitudinally or rotationally to a desired position on the circular rod 116, the member can be expected to remain in that position.

It is the purpose of the mounting member 120 to support the elongate shaft 130 whose lower end extends down into the flexible mold 110, and it is the purpose of the mounting member 122 to support the elongate shaft 132 that extends down into the flexible mold 112. As will be described at greater length hereinafter, a small propeller 134 may be operatively mounted on the lower end of shaft 130 and a small propeller 136 may be operatively mounted on the lower end of shaft 132. Obviously I am not to be limited to propellers, for in some instances I may utilize a disk on the bottom end of each shaft 130 or 132, upon the periphery of which disk, small protrusions are mounted, as will cause circulation of the water in the mold when the disk is caused to rotate. As another alternative, I could use a submersible pump in which a water jet directs water upward, downward, or in a swirling motion around the interior of a mold.

Inasmuch as the members 120 and 122 are of substantially identical construction, it is necessary to reveal additional details of only one of these members. With reference now to FIG. 16*a*, it will be seen that the mounting member 120 has been shown in enlarged detail, with it being apparent that hole 124 extending from side to side has been provided in the member 120, with the hole 124 having an internal diameter sufficient to tightly receive the aforementioned circular rod 116. For the purpose of explanation, the hole 124 can be regarded as residing in a front portion of the member 120.

In order for the elongate shaft 130 to be supported by the member 120, I have provided a vertically disposed hole 126, which may be regarded as residing in a rear portion of the member 120. In other words, the vertically disposed hole 126 is laterally removed from horizontally disposed hole 124 so that the rotatable elongate shaft 130, residing in hole 126, will be entirely out of contact with the circular rod 116 that serves to support the members 120 and 122.

With reference now to the manner in which the elongate shafts 130 and 132 are driven in rotation, so as to bring about rotation of the means, such as the propellers 134 and 136, respectively, I utilize for creating circulation in the molds, I prefer to employ a DC motor 140 for this purpose. The motor 140 may, for example, be affixed to a sturdy support bracket 141 mounted on the sidewall 94 of the tank adjacent the end of circular rod 116.

The motor 140 is a variable speed motor and may be powered from an electric source in the vicinity of 12 volts DC to 24 volts DC. Also, the motor 140 is designed to operate in either rotative direction, so as to make it possible for the user to reverse the direction of circulation of the water in the flexible molds 110 and 112.

Extending upwardly from the motor 140 is a sturdy shaft 142 upon which a pulley 144 is rigidly mounted. The pulley 144 is preferably of hourglass configuration, having a mid portion of comparatively small diameter, with the diameter of the pulley increasing both upwardly and downwardly from this mid portion. The pulley 144 obviously rotates in the same direction and at the same speed as the vertically disposed shaft 142.

It being the intent of the motor 140 and the components 142 and 144 to bring about rotation of the vertically disposed shafts 130 and 132, I provide an hourglass-shaped pulley 150 on the vertical shaft 130, and an hourglass-shaped pulley 152 on the vertical shaft 132. Stretching between the three pulleys 144, 150 and 152 is a belt 154 whose length is adjustable so as to assure sufficient tension to prevent undesirable slippage. I preferably prevent slippage of the belt with respect to the pulley 152 by placing a twist in the belt.

From time to time I wish to reposition the propellers 134 and 136 in their respective molds so as to assure optimum circulation of the water, and also to prevent, when ice starts to form on the inner sides of the molds, each propeller being frozen into a fixed position. To that end, I prefer to create longitudinally extending splines on the vertically disposed shafts 130 and 132 in the vicinity of the pulleys 150 and 152, with the interior of each of these pulleys being splined in a like manner.

With reference to FIG. 16*b*, it can be seen that the shaft 130 is provided with longitudinally extending splines 131, with it to be understood that the interior of pulley 150 is configured to engage the splines in a manner permitting longitudinal motion of the shaft 130, but preventing rotation of the pulley 150 independent of rotation of the shaft 130. Because of this construction, vertical movement of the shaft 130 is readily possible with respect to the pulley 150, and vertical movement of the shaft 132 is readily possible with respect to the pulley 152, with this vertical movement of these shafts not interfering with the continuous transmission of power to the propellers.

To prevent the lower end of shaft 130 dropping to the bottom of mold 110, and the lower end of shaft 132 dropping to the bottom of the mold 112, I provide an adjustable collar 160 on the top of the member 120, which is tightly affixed to shaft 130 so as to prevent undesired downward movement of this shaft without interfering with the rotation of this shaft. Likewise, I provide an adjustable collar 162 on the top of the member 122, which is tightly affixed to shaft 132 so as to prevent undesired downward movement of this shaft without interfering with its rotation.

From the foregoing it should be clear that I may obtain the continuous circulation desired in the interior of the molds 110 and 112 without resorting to the use of compressed gas, although I must be mindful of the need from time to time to raise rotating means utilized in these molds, to prevent the rotating means from interfering with the proper formation of ice in the molds. It is of course apparent that the gas supply tube utilized in accordance with the previously described embodiment for supplying gas to the lowest part of each mold might tend to freeze into position unless it is raised at such time as ice begins to form. However, it is also clear that a gas supply tube is easier to remove from newly-forming ice than is a propeller or other rotative device that is used to provide circulation.

When the propellers or other rotative means have been moved to new heights, the collars 160 and 162 are of course relocated, being moved to new positions in which they will be able to hold the propellers or other rotating means out of contact with the ice newly forming in the molds. The collars are then sufficiently tightened in the new positions on the shafts as to prevent downward slippage of the shafts.

Figure 17:
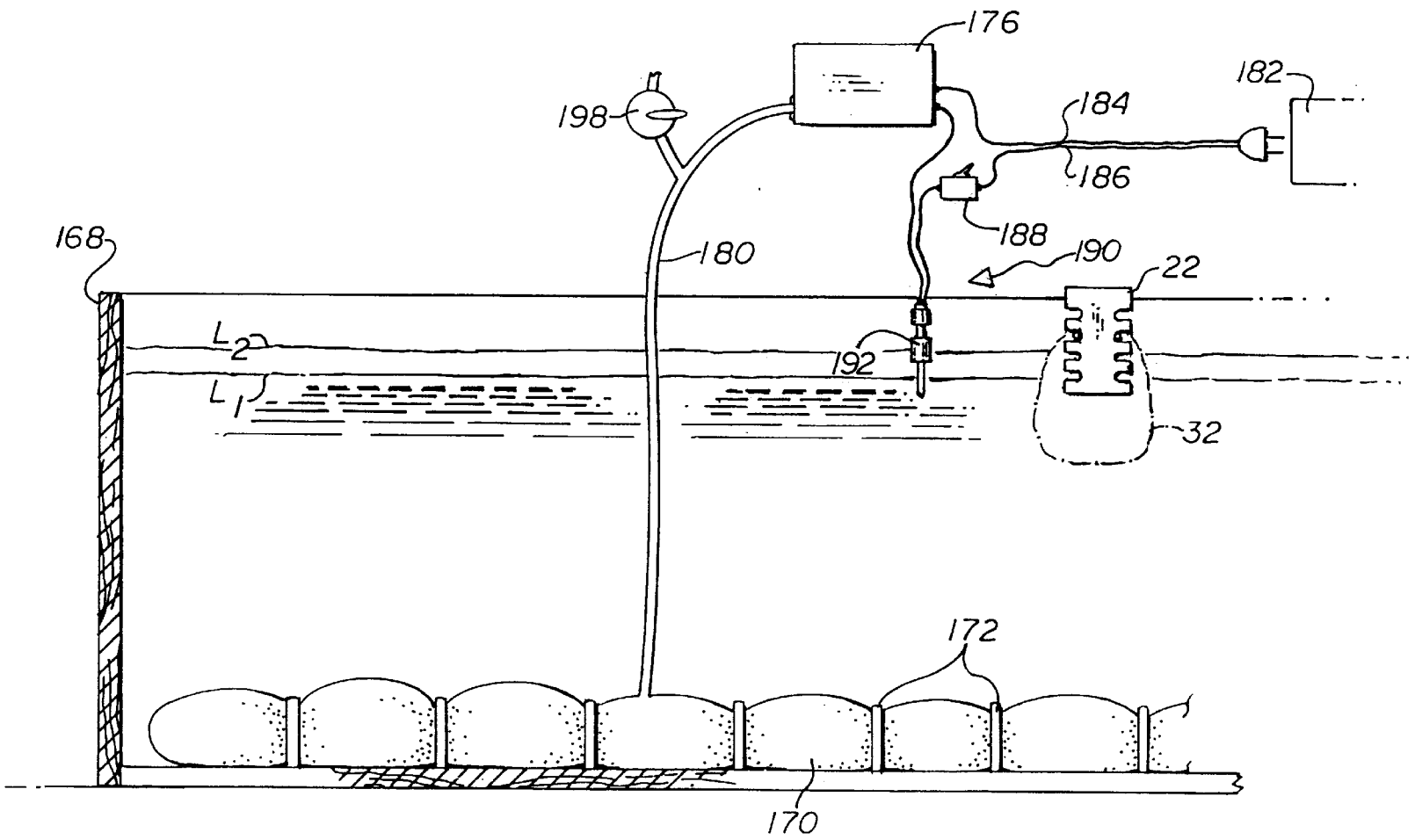
FIG. 17 is a side elevational view, partially in section, of a chiller tank configured to reveal another embodiment of my invention, in this instance involving an inflatable bladder mounted in a relatively low position in the tank, with control devices being utilized such that the bladder can be selectively inflated or deflated to a controlled extent by the operator, with this arrangement making it possible, by inflation of the bladder, for the level of the chilled liquid to be raised in the event warm water has been added to the molds during the procedure of creating crystal clear ice objects.

Turning now to FIG. 17, it will be seen that in this embodiment of my invention, level control of the liquid in the tank 168 is effectively brought about by the utilization of an inflatable bladder 170 that is typically mounted adjacent the lower interior surface of the tank, but obviously I am not to be limited to this location inasmuch as the bladder can be mounted in a number of different submerged locations in the tank. The bladder may for example be made of vinyl, but obviously I am not to be limited to this. To permit the bladder to expand and contract to change the level of the chilled liquid in the tank at the behest of the operator, I prefer to utilize a series of circularly-shaped mounting clamps 172 that are tightly secured to the bottom or lower sidewall of the tank, into which the bladder is relatively loosely inserted.

A compressed air source is utilized in accordance with this embodiment of my invention, which may be either a relatively small electrically powered air compressor 176, or a large air supply pneumatically connected to a normally closed air control solenoid type valve utilized in place of air compressor 176. As will be noted from FIG. 17, the compressed air source is connected by a tube 180 to the bladder 170. If an air compressor 176 is utilized, it is connected to a suitable electrical power source 182 by electrical leads 184 and 186. The power source can for example be 115 volts AC, or it can be 12 volts DC or 24 volts DC, or in some instances, still another voltage.

In accordance with this invention, I may interpose in electric lead 186, a level control device 190 for limiting the inflation of the bladder 170. The inflation or deflation of the bladder is of course controlled in a manner serving to keep the chilled liquid level in the tank 168 in a proper relationship to the water in the flexible molds as the water level in the molds is caused to change as a result of relatively warm water being used to de-slush the ice initially beginning to form within the molds.

One particularly important component associated with control means 190 is a liquid level switch 192, which may for example be of the type manufactured by Madison Company of Branford, Conn. Obviously, however, I am not to be limited to a particular type of liquid level switch, nor to any one manufacturer.

The liquid level switch 192 is typically mounted near the top of the sidewall of the tank, thus being positioned to sense the level of the chilled liquid in the tank. An on-off switch 188 is interposed in the electric lead 186 from the electrical power source 182, which switch enables the user to turn on the air compressor 176 to bring about the desired amount of inflation of the bladder 170 as will cause the chilled liquid level in the tank to increase from level L1 to level L2.

As a result of the functioning of the liquid level switch 192, the level of the chilled liquid in the tank 168 will automatically stop increasing when the preset level L2 has been reached.

Although the details of the liquid level switch 192 form no part of this invention, it may be noted in passing that such a switch may involve a magnet-containing float positioned to sense liquid level, which is used in combination with a reed switch encapsulated within a vertically disposed stem upon which the float is operatively mounted.

Normally the reed switch contacts are closed when the float is at a relatively low level, such as at L1. When as a result of the operator bringing about the operation of the air compressor and the consequent inflation of the bladder 170, the float eventually rises to its actuating point, which is adjustable. The magnet contained in the float causes the normally closed contacts of the reed switch to open, stopping the further inflation of the bladder either by stopping the air compressor or by closing the solenoid controlling the flow of air from the air tank representing the supply of compressed air.

In other words, in accordance with a preferred operation of this embodiment of my invention, the switch 192, rather than the operator, turns off the air compressor (or the solenoid valve) at such time as the preset level of the chilled liquid in the tank has been reached. This may be regarded as semi-automatic operation.

In larger embodiments an electric relay may be required between the level switch and the compressor or solenoid in order to carry a higher current load than the level switch is designed to carry.

Thereafter, subsequent to the completion of the creation of the intricate items of ice, the molds are removed from the elongate rods 30, and the deflation valve 198 opened to permit the air in the bladder 170 to escape, thus bringing about a lowering of the chilled level in the tank 168 back to level L1, its previous level. Also at this time, the operator will typically place the switch 188 in the off position.

As should be obvious, in accordance with this embodiment of my invention, it is unnecessary to utilize notched brackets of the type described in conjunction with FIG. 1 inasmuch as it is not necessary for the operator to reposition the elongate rods utilized to support the flexible molds each time more water is added to the molds. It still may be desirable, however, to utilize the notched brackets inasmuch as from time to time it may be desirable to change to other types of molds, which require different elevations of the mounts.

It should now be apparent that in accordance with this invention, I have described and illustrated a novel method and apparatus enabling crystal clear ice objects of intricate configuration to be created by the use of flexible silicone-like molds. As mentioned hereinabove, the use of these molds may often require a special technique involving a deliberate initial thawing of the first formed ice or slush, thus to bring about, at the time of refreezing, crystal clear ice free of imperfections.

It should also be apparent that in accordance with a preferred embodiment of this invention I have provided a novel apparatus for supplying controlled amounts of a suitable gas, such as air, to cause circulation in each of a series of flexible molds partially immersed in a tank of chilled liquid, in which molds, intricate ice objects are to be created. In this embodiment, a relatively small supply tube may be utilized for supplying controlled amounts of air to each mold, with the air rising up through the water contained in each of the molds inducing circulation serving to prevent the formation of cloudy ice. This supply tube is movable so as to permit the operator to cause gas to be supplied to whatever location happens to be the most appropriate location in a given mold in order that the desired circulation will be achieved.

I claim:

1. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, the interior surfaces of said mold being rough, said support arrangement including support means operatively engaging said upper portion of said flexible mold and supporting said mold with a selected extent of the principal portion of the mold immersed below the surface of the chilled liquid, and means for causing circulation of the water in the mold, so that the interior sides of the mold will be swept, thus preventing the formation of cloudy ice.

2. The support arrangement for supporting a flexible, water-containing mold of intricate configuration in a tank as recited in claim 1 in which said means for causing circulation of the water in the mold includes gas supply means for supplying controlled amounts of gas to a lower interior portion of the mold, said gas supply means including a gas supply tube whose position in the mold is adjustable, whereby suitable amounts of gas can be caused to rise up through the water contained in the mold, thus to assure circulation of water in the mold.

3. The support arrangement for supporting a flexible, water-containing mold of intricate configuration in a tank as recited in claim 2 in which said gas supply means also includes a relatively stiff gas delivery pipe extending across the between the supporting sides of the tank, and at least one relatively short hollow support tube movably supported from said gas delivery pipe, said hollow support tube forming the support for said gas supply tube, said gas supply tube being flexible and slidably mounted in said hollow support tube, the user being enabled to move said gas supply tube with respect to said hollow support tube, thus to be able to readily change the position of the lower end of said flexible gas supply tube with respect to the bottom of the mold.

4. The support arrangement for supporting a flexible, water-containing mold of intricate configuration in a tank as recited in claim 3 in which said hollow support tube is mounted on said relatively stiff gas delivery pipe in such a manner as to be movable rotationally as well as longitudinally.

5. The support arrangement for supporting a flexible, water-containing mold of intricate configuration in a tank as recited in claim 3 in which a hand operated gas flow control means is operatively associated with said gas supply tube, so that the rate of flow of the gas flowing through said gas supply tube into a lower portion of the mold can be closely controlled.

6. The support arrangement for supporting a flexible, water-containing mold of intricate configuration in a tank as recited in claim 1 in which said means for causing circulation of the water in the mold includes power driven rotatable means disposed in the mold.

7. The support arrangement for supporting a flexible, water-containing mold in a tank as recited in claim 1 in which the interior of said mold is substantially spherical in shape, so that an ice object that is also substantially spherical in shape can be created therein.

8. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, the interior surfaces of said mold being rough, said support arrangement including support means operatively engaging said upper portion of said flexible mold and supporting said mold with a selected extent of the principal portion of the mold immersed below the surface of the chilled liquid, and means for causing circulation of the water in the mold, so that the interior sides of the mold will be swept, thus preventing the formation of cloudy ice, said support means including height adjustment means for selectively adjusting the height of said mold with respect to the surface of the chilled liquid.

9. The support arrangement for supporting a flexible, water-containing mold of intricate configuration in a tank as recited in claim 8 in which said height adjustment means includes a plurality of elongate rods, and a pair of brackets utilized at opposite locations on the supporting sides of the tank for the support of the ends of the rods, said brackets each being equipped with a plurality of evenly spaced, rod-receiving notches, whereby the height at which said rods are supported above the surface of the chilled liquid can be readily adjusted, thus to make it readily possible for the extent that said principal portion of said mold is immersed in the chilled liquid to be closely controlled.

10. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, the interior surfaces of said mold being rough, said support arrangement including support means operatively engaging said upper portion of said flexible mold and supporting said mold with a selected extent of the principal portion of the mold immersed below the surface of the chilled liquid, and means for causing circulation of the water in the mold, so that the interior sides of the mold will be swept, thus preventing the formation of cloudy ice, the height of said mold with respect to the surface of the chilled liquid being selectively adjusted by the utilization of an inflatable bladder disposed below the surface of the chilled liquid in the tank, and selectively operable inflation means for controlling the inflation of said bladder, with the enlargement of said bladder serving to raise the level of coolant in said tank with respect to said mold during one phase of the creation of the item of clear ice.

11. The support arrangement for supporting a flexible, water-containing mold of intricate configuration in a tank as recited in claim 10 in which deflation means are provided for permitting the substantial diminishment of pressure from said bladder when the creation of the item of clear ice is substantially complete, such as to bring about a reduction of the level of the coolant liquid in the tank.

12. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, said flexible mold also having interior surfaces possessing a distinctive degree of roughness, said support arrangement involving elongate support means for operatively engaging said upper portion of said flexible mold, said elongate support means being of a length sufficient to span between the supporting sides of the tank such that said mold can be supported with a selected extent of the principal portion of the mold immersed below the surface of the chilled liquid, and means for causing circulation of the water in the mold so that the interior sides of the mold will be swept, thus preventing the formation of cloudy ice.

13. The support arrangement for supporting a flexible, water-containing mold of intricate configuration in a tank having supporting sides and containing a chilled liquid as recited in claim 12 in which said means for causing circulation of the water in the mold includes gas supply means utilized for supplying controlled amounts of gas to a lower interior portion of the mold, said gas supply means including a gas supply tube whose position in the mold is adjustable, whereby suitable amounts of gas can be caused to rise up through the water contained in the mold, thus to prevent the formation of cloudy ice.

14. The support arrangement for supporting a flexible, water-containing mold of intricate configuration in a tank as recited in claim 13 in which said gas supply means also includes a relatively stiff gas delivery pipe extending across the between the supporting sides of the tank, and at least one relatively short hollow support tube that is movably supported from said gas delivery pipe, said hollow support tube forming the support for said gas supply tube, said gas supply tube being flexible and slidably mounted in said hollow support tube, the user being enabled to move said gas supply tube with respect to said hollow support tube, thus to be able to readily change the position of the lower end of said gas supply tube with respect to the bottom of the mold.

15. The support arrangement for supporting a flexible, water-containing mold of intricate configuration in a tank as recited in claim 14 in which said hollow support tube is mounted on said relatively stiff gas delivery pipe in such a manner as to be movable rotationally as well as longitudinally.

16. The support arrangement for supporting a flexible, water-containing mold of intricate configuration in a tank as recited in claim 14 in which a hand operated gas flow control means is operatively associated with said gas supply tube, so that the amount of gas flowing through said gas supply tube into a lower portion of the mold can be closely controlled.

17. The support arrangement for supporting a flexible, water-containing mold of intricate configuration in a tank as recited in claim 12 in which said means for causing circulation of the water in the mold includes power driven rotatable means disposed in said mold.

18. The support arrangement for supporting a flexible, water-containing mold in a tank as recited in claim 12 in which the interior of said mold is substantially spherical in shape, so that an ice object that is also substantially spherical in shape can be created therein.

19. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, said flexible mold also having interior surfaces possessing a distinctive degree of roughness, said support arrangement involving elongate support means for operatively engaging said upper portion of said flexible mold, said elongate support means being of a length sufficient to span between the supporting sides of the tank such that said mold can be supported with a selected extent of the principal portion of the mold immersed below the surface of the chilled liquid, and means for causing circulation of the water in the mold so that the interior sides of the mold will be swept, thus preventing the formation of cloudy ice, height adjustment means operatively associated with said support means enabling an adjustment of the height of said mold with respect to the surface of the chilled liquid.

20. The support arrangement for supporting a flexible, water-containing mold of intricate configuration in a tank as recited in claim 19 in which said elongate support means involves a plurality of elongate rods, said rods being used in combination with a pair of brackets utilized at opposite locations on the supporting sides of the tank for the support of the ends of the rods, said brackets each being equipped with a plurality of evenly spaced, rod-receiving notches, whereby the height of said rods above the surface of the chilled liquid can be readily adjusted, thus to make it readily possible for the extent that said principal portion of said mold is immersed in the chilled liquid to be closely controlled.

21. A support arrangement for supporting a flexible, water-containing mold of intricate configuration in a tank having supporting sides and containing a chilled liquid, such that an item of crystal clear ice can be created in the flexible mold, said mold having an upper, support portion and a lower, principal portion, said flexible mold also having interior surfaces possessing a distinctive degree of roughness, said support arrangement involving elongate support means for operatively engaging said upper portion of said flexible mold, said elongate support means being of a length sufficient to span between the supporting sides of the tank such that said mold can be supported with a selected extent of the principal portion of the mold immersed below the surface of the chilled liquid, and means for causing circulation of the water in the mold so that the interior sides of the mold will be swept, thus preventing the formation of cloudy ice, the height of said mold with respect to the surface of the chilled liquid being selectively adjusted by the utilization of an inflatable bladder disposed below the surface of the chilled liquid in the tank, and selectively operable inflation means for controlling the inflation of said bladder, with the enlargement of said bladder serving to raise the level of coolant in said tank with respect to said mold during one phase of the creation of the item of clear ice.

22. The support arrangement for supporting a flexible, water-containing mold of intricate configuration in a tank as recited in claim 21 in which deflation means are provided for permitting the substantial diminishment of pressure from said bladder when the creation of the item of clear ice is substantially complete, such as to bring about a reduction of the level of the coolant liquid in the tank.

23. A method for creating objects of crystal clear ice by the use of a flexible, water-containing mold of intricate configuration partially immersed in a chilled liquid, said method comprising the steps of pouring water into the mold so as to substantially fill same, supporting the mold adjacent the surface of the chilled liquid such that the lower, principal portion of the mold is immersed in the liquid, supplying controlled amounts of gas to a lower interior portion of the mold during such immersion so as to cause suitable amounts of gas to rise up through the water contained in the mold, thus to prevent the formation of cloudy ice, and after initial ice crystals begin to form, adding a controlled amount of heat to the interior of the mold so as to thaw the ice beginning to form, so that the formation of clear ice can thereafter commence, and after the ice object of crystal clear ice has fully formed, removing the flexible mold from around the ice object, the controlled amount of heat being applied by adding a relatively small quantity of relatively warm water to the water in the mold, so as to cause the melting of the previously formed ice.

24. A method for creating objects of crystal clear ice by the use of a flexible, water-containing mold of intricate configuration partially immersed in a chilled liquid, said method comprising the steps of pouring water into the mold so as to substantially fill same, supporting the mold adjacent the surface of the chilled liquid such that the lower, principal portion of the mold is immersed in the liquid, supplying controlled amounts of gas to a lower interior portion of the mold during such immersion so as to cause suitable amounts of gas to rise up through the water contained in the mold, thus to prevent the formation of cloudy ice, and after initial ice crystals begin to form, adding a controlled amount of heat to the interior of the mold so as to thaw the ice beginning to form, so that the formation of clear ice can thereafter commence, and after the ice object of crystal clear ice has fully formed, removing the flexible mold from around the ice object, the controlled amount of heat being applied by inserting a warm object into the ice which has previously formed in the mold, so as to cause the melting of same.

25. A method for creating objects of crystal clear ice by the use of a flexible, water-containing mold of intricate configuration partially immersed in a chilled liquid, said method comprising the steps of pouring water into the mold so as to substantially fill same, supporting the mold adjacent the surface of the chilled liquid such that the lower, principal portion of the mold is immersed in the liquid, supplying controlled amounts of gas to a lower interior portion of the mold during such immersion so as to cause suitable amounts of gas to rise up through the water contained in the mold, thus to prevent the formation of cloudy ice, and after initial ice crystals begin to form, adding a controlled amount of heat to the interior of the mold so as to thaw the ice beginning to form, so that the formation of clear ice can thereafter commence, the heat being applied by adding a relatively small quantity of water that is warm relative to the water already in the mold, so as to cause the melting of the previously formed ice, and after the ice object of crystal clear ice has fully formed, removing the flexible mold from around the ice object.

26. A method for creating a spherically shaped object of crystal clear ice by the use of a flexible, water-containing mold having a spherically shaped lower portion to be immersed in a chilled liquid, said method comprising the steps of pouring water into the mold so as to substantially fill same, supporting the mold adjacent the surface of the chilled liquid such that the lower, spherically shaped portion of the mold is immersed in the liquid, supplying controlled amounts of gas to a lower interior portion of the mold during such immersion so as to cause suitable amounts of gas to rise up through the water contained in the mold, thus to prevent the formation of cloudy ice, and after initial ice crystals begin to form, adding a controlled amount of heat to the interior of the mold so as to thaw the ice beginning to form, so that the formation of clear ice can thereafter commence, and after the spherically shaped ice object of crystal clear ice has fully formed, removing the flexible mold from around the ice object.

27. A support arrangement for supporting a flexible, water-containing mold in a tank having supporting sides and containing a chilled liquid, such that an item of crystal clear ice of spherical configuration can be created in the flexible mold, said mold having an upper, support portion and a lower, principal portion of spherical configuration, the interior surfaces of said mold being rough, with such surface roughness being in the range between the equivalent of a grit size of 1500 and the equivalent of a grit size of 40, said support arrangement including support means operatively engaging said upper portion of said flexible mold and supporting said mold with a selected extent of the principal, spherically shaped portion of the mold immersed below the surface of the chilled liquid, and means for causing circulation of the water in the principal, spherically shaped portion of the mold, so that the interior sides of the mold will be swept, thus preventing the formation of cloudy ice.

* * * * *